US005671587A

United States Patent [19]

Robinson

[11] Patent Number: 5,671,587

[45] Date of Patent: Sep. 30, 1997

[54] METHOD AND APPARATUS FOR LOADING BOTTOM-LOADING BASKET-STYLE CARRIER

[75] Inventor: Glenn Robinson, Atlanta, Ga.

[73] Assignee: The Mead Corporation, Dayton, Ohio

[21] Appl. No.: 421,113

[22] Filed: Apr. 13, 1995

[51] Int. Cl.[6] ..... B65B 21/14; B65B 21/24; B65B 5/06; B65B 43/26

[52] U.S. Cl. ..... 53/398; 53/48.1; 53/48.7; 53/48.8; 53/242; 53/539

[58] Field of Search ..... 53/48.1, 48.7, 53/48.8, 242, 539, 543, 398

[56] References Cited

U.S. PATENT DOCUMENTS

| | | | |
|---|---|---|---|
| Re. 27,624 | 4/1973 | Helms | 206/141 |
| 2,276,129 | 3/1942 | Wesselman | 53/48.1 X |
| 2,603,924 | 7/1952 | Currie et al. | 53/48.1 |
| 3,521,427 | 7/1970 | Masch | 53/48.1 |
| 3,627,193 | 12/1971 | Helms | 53/48.1 X |
| 3,698,151 | 10/1972 | Arneson | 53/48.1 X |
| 3,701,230 | 10/1972 | Gentry | 53/48.7 |
| 3,721,368 | 3/1973 | Arneson | 206/180 |
| 3,747,294 | 7/1973 | Calvert et al. | 53/48.1 |
| 3,751,872 | 8/1973 | Helms | 53/458 |
| 3,766,704 | 10/1973 | Ganz | 53/48.7 |
| 3,805,484 | 4/1974 | Rossi | 53/543 |
| 3,842,571 | 10/1974 | Focke et al. | 53/564 |
| 3,848,519 | 11/1974 | Ganz | 53/48.1 X |
| 3,924,385 | 12/1975 | Walter | 53/48.1 |
| 3,940,907 | 3/1976 | Ganz | 53/48.7 X |
| 4,802,324 | 2/1989 | Everson | 53/398 |
| 4,915,218 | 4/1990 | Crouch et al. | 206/178 |
| 4,919,261 | 4/1990 | Lashyro et al. | 206/185 |
| 5,234,103 | 8/1993 | Schuster | 206/158 |

*Primary Examiner*—Horace M. Culver
*Attorney, Agent, or Firm*—Michael V. Drew

[57] ABSTRACT

An apparatus for loading containers into basket-style bottom-loading carriers has a container infeed conveyor; a divider for segregating the containers into columns; a container meterer for metering each of the columns of containers into groupings of a predetermined number of containers; a container conveyor for engaging the last container in each grouping of containers; container gripper conveyors having container grippers for maintaining the container groupings; a carrier infeed supplier; a carrier feeder for removing carriers from the carrier infeed supplier; a carrier timer-transport assembly for receiving carriers from the carrier feeder and initiating transport of the carriers in synchronous parallel motion above the containers; a gripper assembly for opening the carriers by grasping and pulling outwardly with respect to a centerline of the carriers the bottom panels; a declination belt assembly having a downwardly-declining pair of opposing elongated endless belt pairs in face contacting relationship forming a pathway for receiving transversely extending bottom panels of said carriers and transporting said carriers downwardly over the groupings of containers; a seating assembling having a plurality of members each having a groove for engaging tops of handles of carriers with the members in rotatable cooperative disposition with respect to the carriers which have be placed over the groupings of containers such that as the members rotate the bottommost member engages the respective tops of the handles of the carriers; and means for placing the bottom panels together in locking relationship with respect to one another.

9 Claims, 23 Drawing Sheets

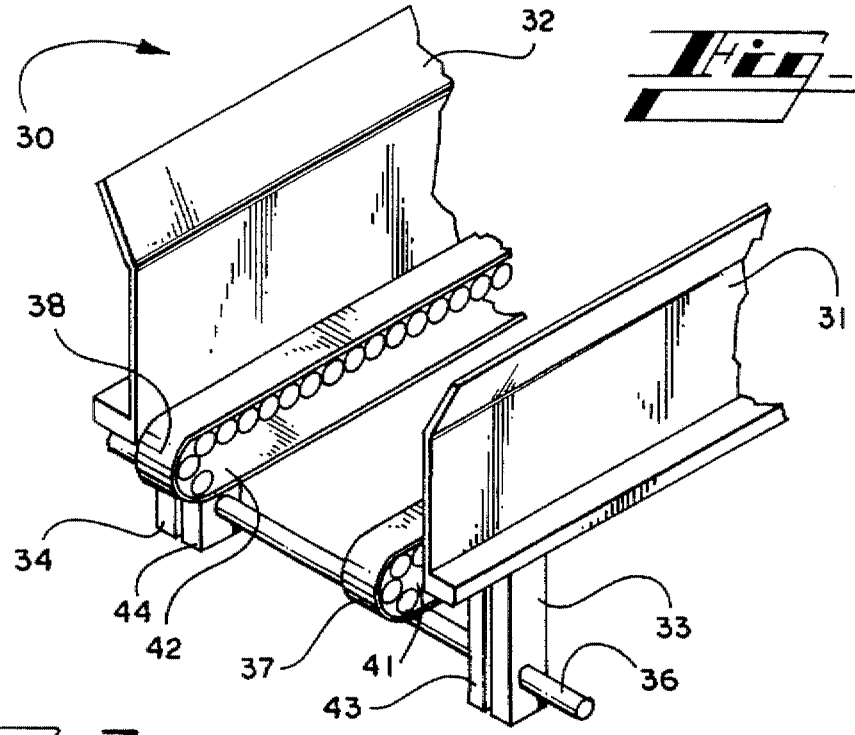
Fig_6
Fig_7
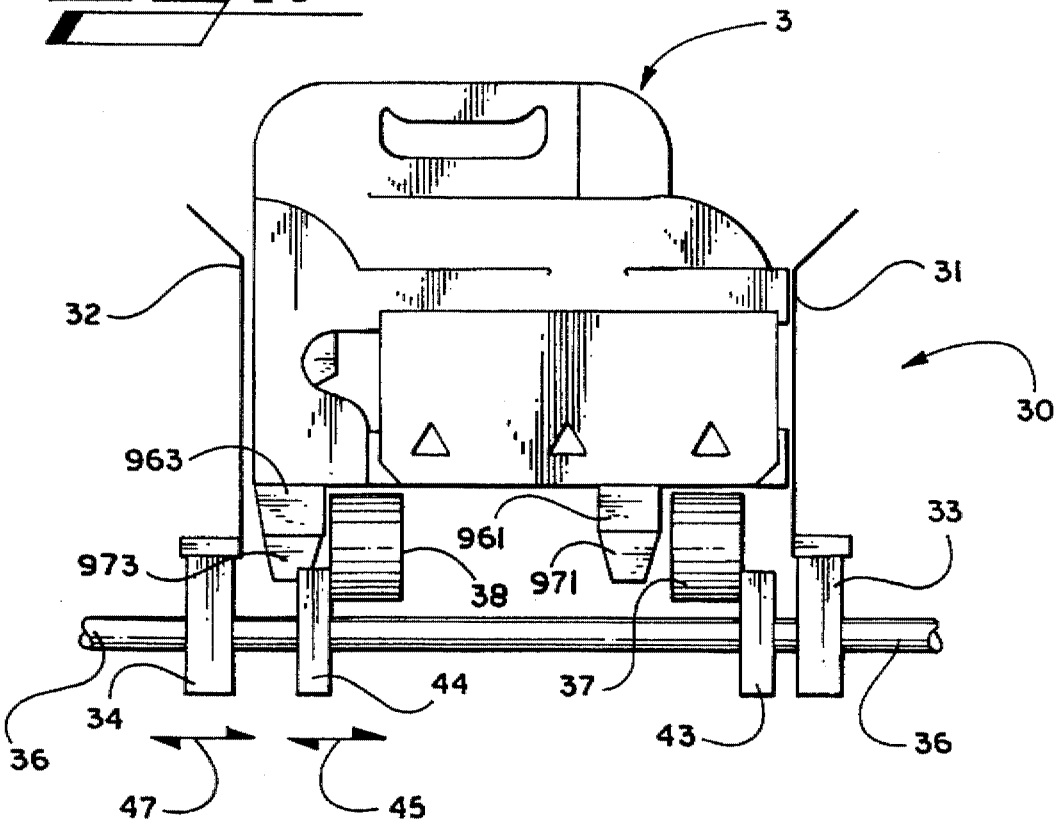

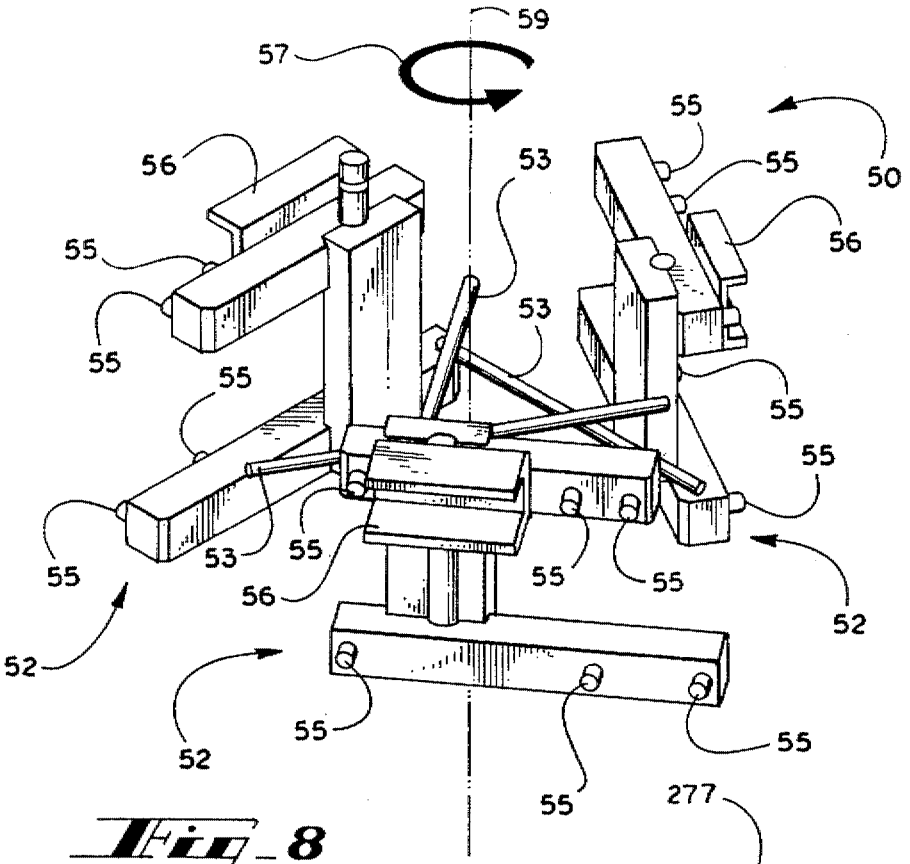
Fig_8
Fig_10
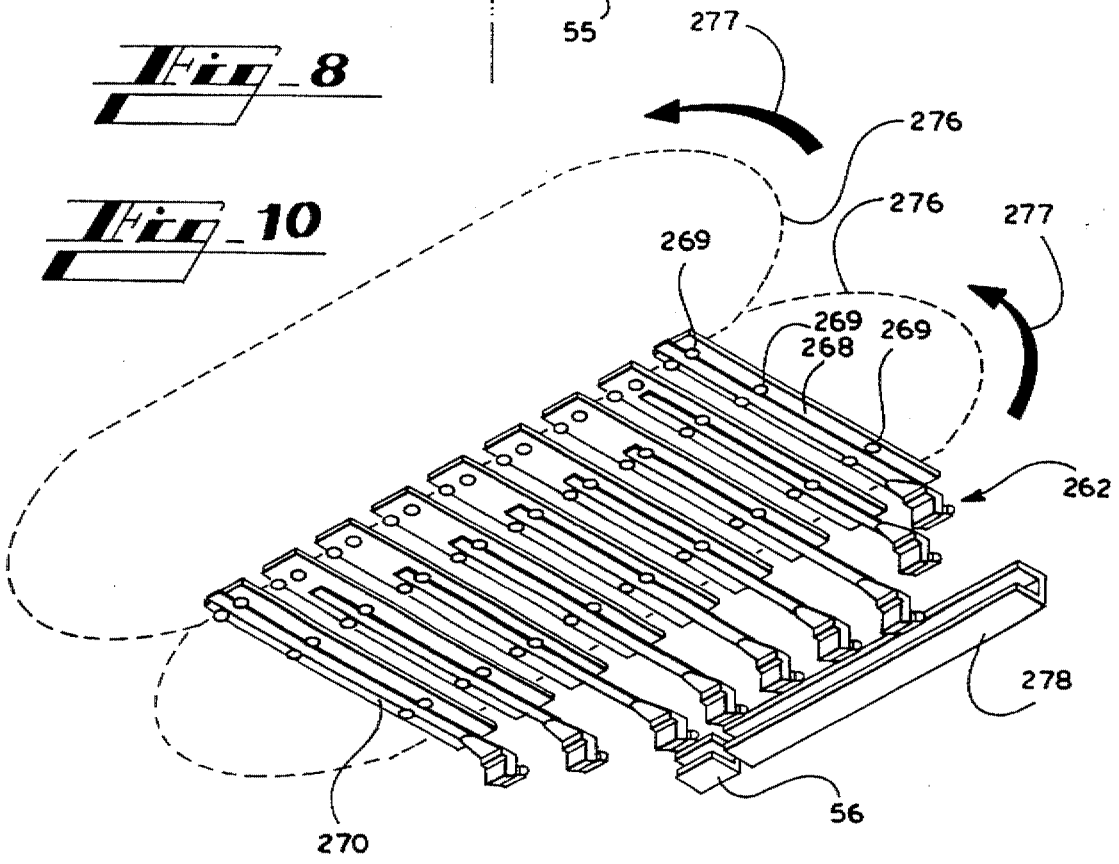

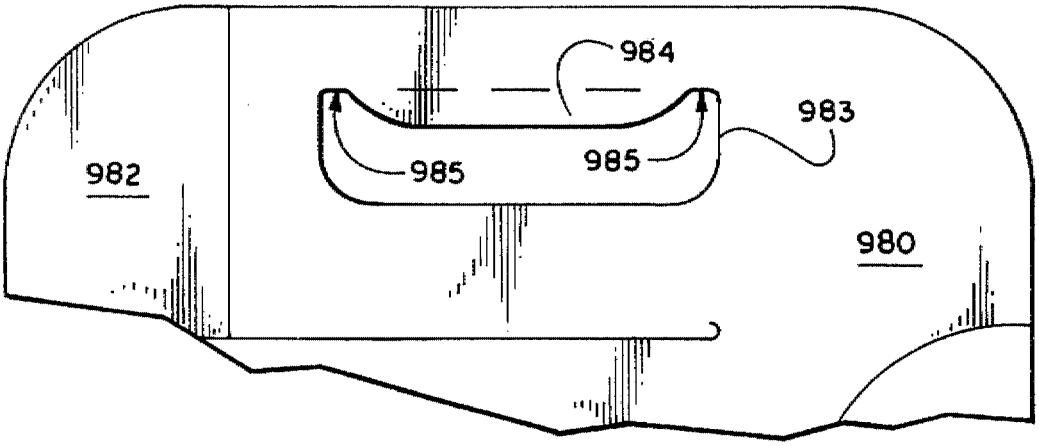
Fig_12
Fig_14
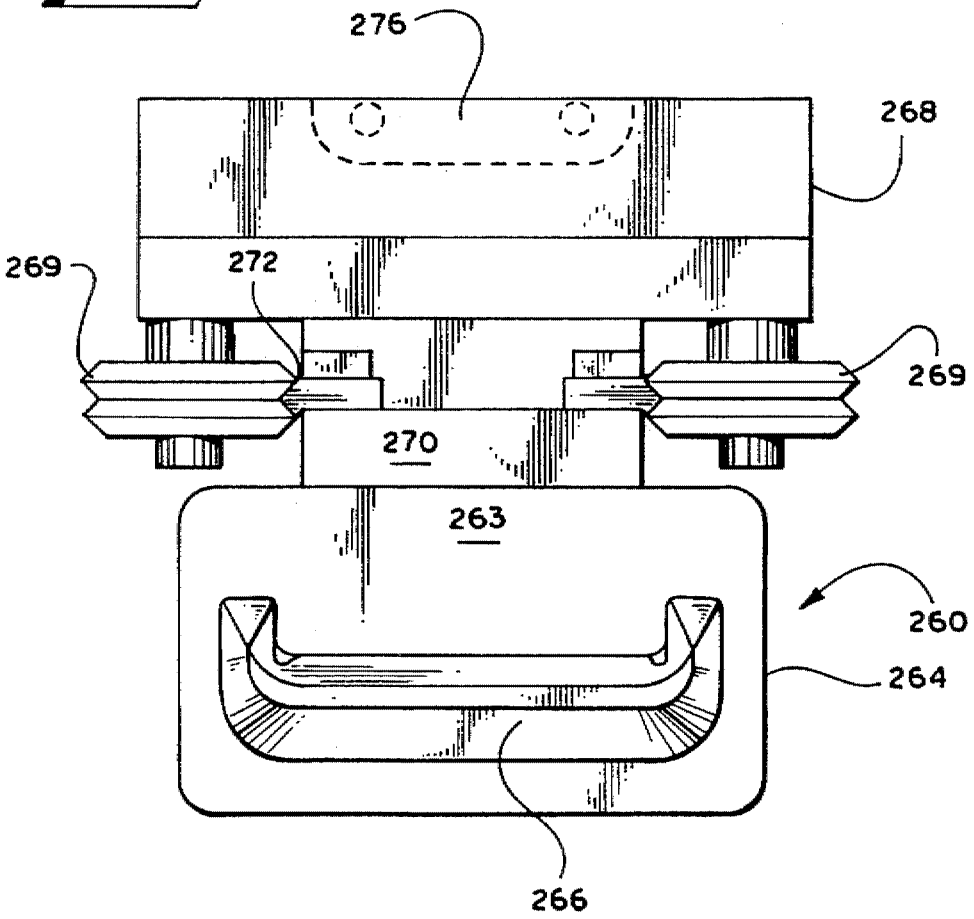

METHOD AND APPARATUS FOR LOADING BOTTOM-LOADING BASKET-STYLE CARRIER

TECHNICAL FIELD OF THE INVENTION

The invention relates to bottom-loading basket-style carriers for articles such as beverage bottles.

BACKGROUND OF THE INVENTION

Previous methods and apparatus for loading bottles into basket-style carriers from the bottom are disclosed in U.S. Pat. No. 2,276,129 to Wesselman, U.S. Pat. No. 2,603,924 to Currie et al., U.S. Pat. No. 3,521,427 to Masch, U.S. Pat. No. 3,627,193 to Helms, U.S. Pat. No. 3,698,151 to Arneson, U.S. Pat. No. 3,751,872 to Helms, U.S. Pat. No. 3,747,294 to Calvert et al., U.S. Pat. No. 3,805,484 to Rossi, U.S. Pat. No. 3,842,571 to Focke et al., U.S. Pat. No. 3,848,519 to Ganz, U.S. Pat. No. 3,924,385 to Walter, U.S. Pat. No. 3,940,907 to Ganz, U.S. Pat. No. 4,915,218 to Crouch et al., U.S. Pat. No. 4,919,261 to Lashyro et al., U.S. Pat. No. 5,234,103 to Schuster, and U.S. Pat. No. Re. 27,624.

SUMMARY OF THE INVENTION

The present invention provides a method and apparatus for the continuous opening and loading basket-style bottom-loading carriers.

In accordance with a preferred embodiment of the invention an apparatus for loading containers into basket-style bottom-loading carriers has a first container infeed conveyor; a divider disposed proximate said container infeed conveyor for segregating the containers into columns; a container meterer for metering each of said columns of containers into groupings of a predetermined number of containers; a second container conveyor having members attached to said conveyor for engaging a last container in each said grouping of containers; container gripper conveyors having container grippers for maintaining said container groupings; a carrier infeed supplier; a carrier feeder for removing carriers from said carrier infeed supplier; a carrier timer-transport assembly for receiving carriers from said carrier feeder and initiating transport of the carriers in synchronous parallel motion above the containers; a gripper assembly for opening the carriers by grasping and pulling outwardly with respect to a centerline of the carriers the bottom panels; a declination belt assembly having a downwardly-declining pair of opposing elongated endless belt pairs in face contacting relationship forming a pathway for receiving transversely extending bottom panels of said carriers and transporting said carriers downwardly over said groupings of containers; a seating assembling having a plurality of members having a groove for engaging tops of handles of carriers said members in rotatable cooperative disposition with respect to the carriers which have be placed over said groupings of containers such that as said members rotate a bottommost member engages the respective tops of the handles of the carriers; and means for placing the bottom panels together in locking relationship with respect to one another.

Other advantages and features of the present invention will be apparent from the following description, the accompanying drawings, and the appended claims.

BRIEF DESCRIPTION OF THE DRAWINGS

FIG. 6 is an isometric illustration of a hopper for the apparatus of FIG. 5.

FIG. 7 is an elevational view of the hopper of FIG. 6 loaded with at least one carrier.

FIG. 8 is an isometric illustration of a carton feeder of the apparatus of FIG. 5.

FIG. 10 is an isometric illustration of a handhold-aperture insert assembly of a timing-transport section for use with the apparatus of FIG. 5.

FIG. 12 is an illustration of a modified handle portion of the carrier of FIG. 1.

FIG. 14 is a partial front end view of the features of the handhold-aperture insert assembly illustrated in FIG. 13.

DETAILED DESCRIPTION OF THE PREFERRED EMBODIMENT

The Carrier

Figure 1:
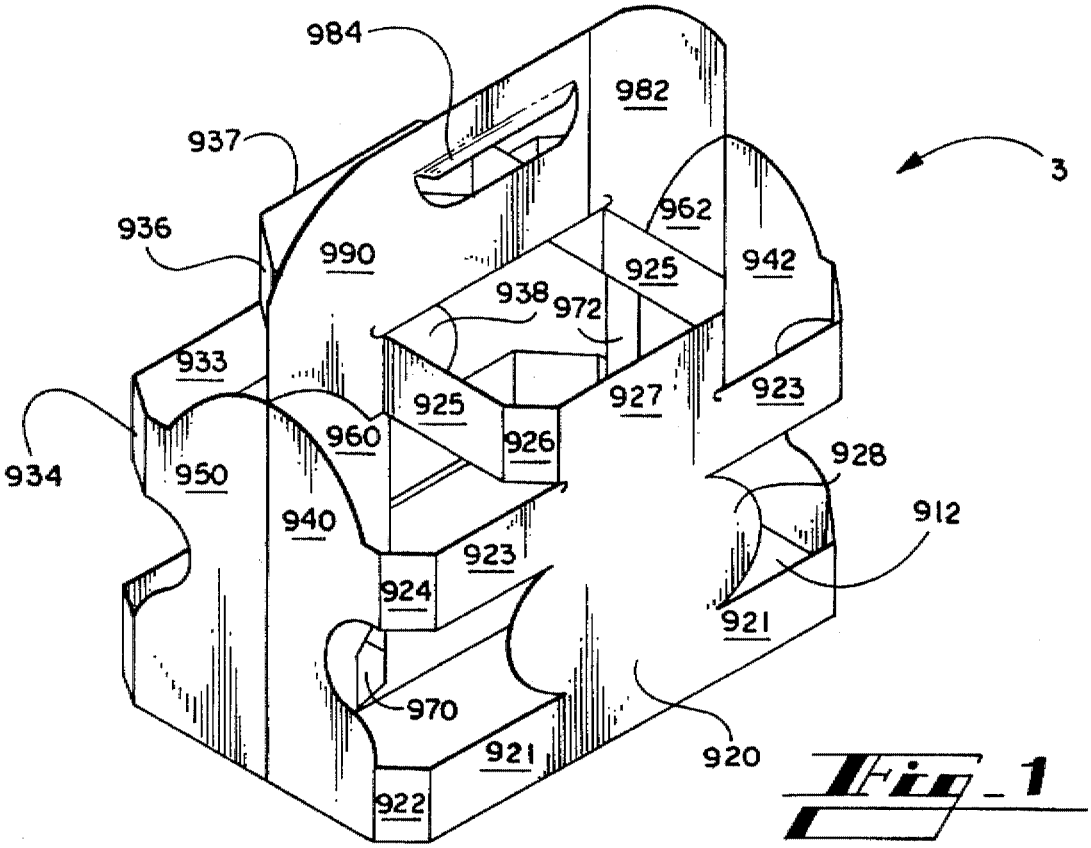
FIG. 1 is an isometric illustration of a carrier suitable for loading by an apparatus for loading bottom-loading basket-style carriers according to a preferred embodiment of the invention.
Figure 3:
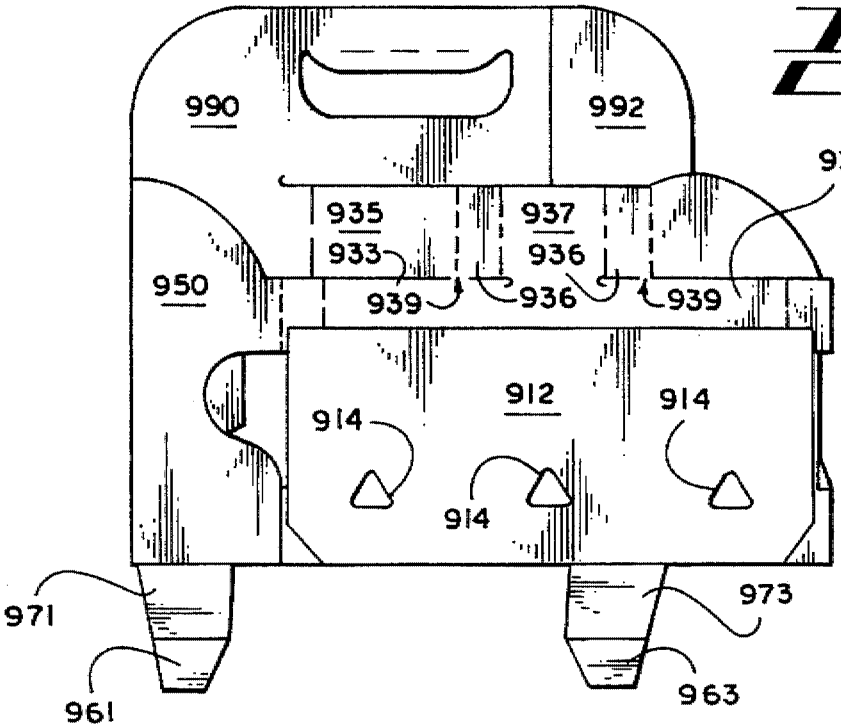
FIG. 3 is an illustration of the carrier of FIG. 1 in collapsed condition.
Figure 2:
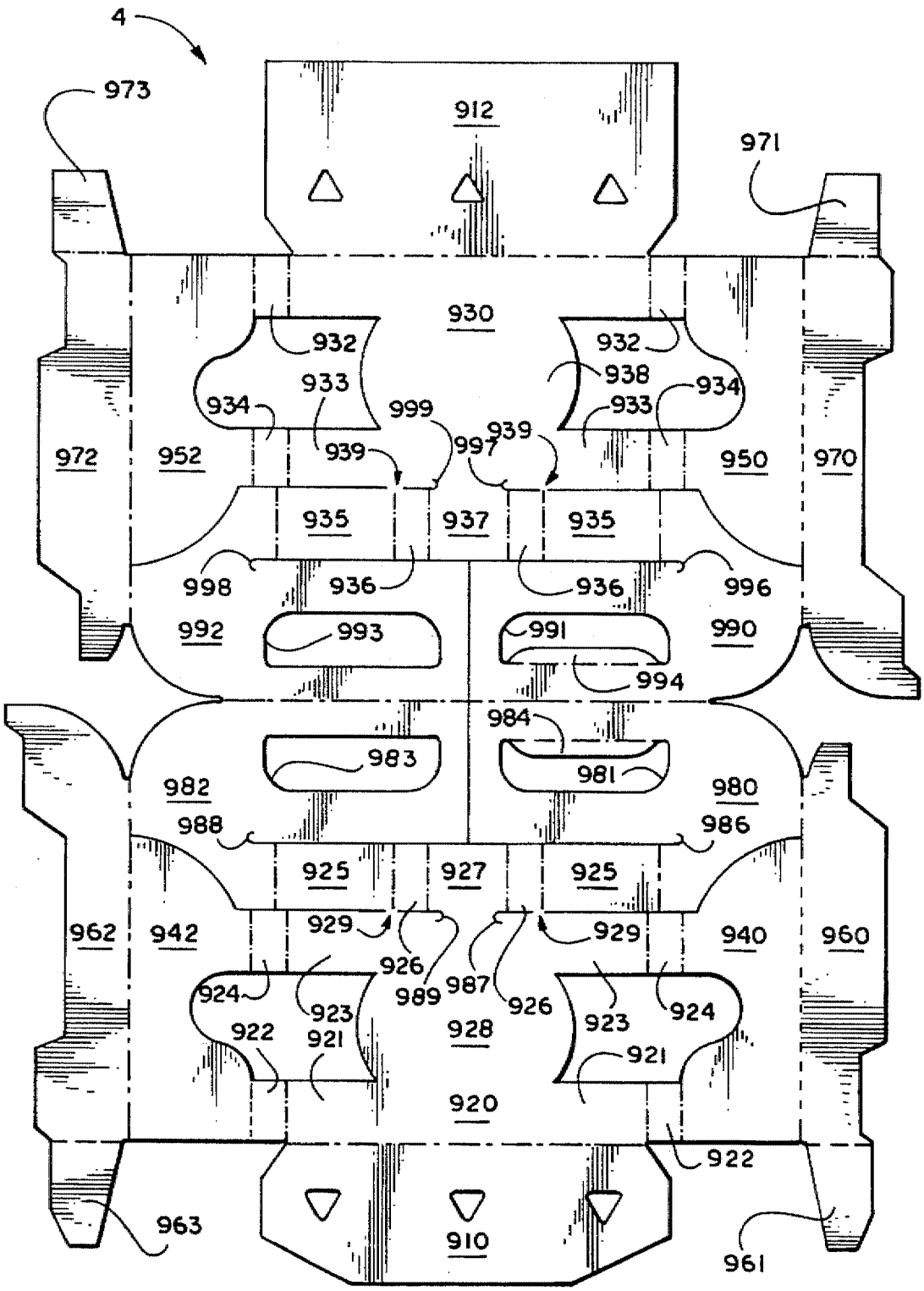
FIG. 2 is a plan view of a blank for forming the carrier of FIG. 1.

The method and apparatus 10 described herein as the preferred embodiment of the invention is particularly suitable for loading carriers such as the bottom-loading basket-style carrier 3 shown in FIG. 1. Although use of the method and apparatus 10 of the subject invention is not limited to the carrier 3 described below, the features of the invention are very clearly described by reference to the invention's handling and loading of the carrier 3 illustrated. A blank 906 for forming the carrier 3 is shown in FIG. 2. FIG. 3 is a plan view of the collapsed carrier 3 of FIG. 1.

The carrier 3 is of the nature described in U.S. patent application Ser. No. 08/326,987. That application is also owned by the owner of the present invention application. The carrier 3 and blank 906 for forming the carrier 3 are described below to facilitate understanding of the invention. First, reference is made to FIGS. 1 and 2 simultaneously. The carrier 3 illustrated is generally designed to accommodate two rows of bottles. The examples of carriers 3 discussed herein describe use of the invention with carriers 3 that accommodate two rows of three bottles and two rows of four bottles, that is, a six-pack version and an eight pack version. However, the invention may also be practiced to accommodate rows of other multiples of bottles. Both sides of the carrier are the same. Thus, the features described with respect to the side shown in FIG. 1 are equally applicable to the unseen side. The side wall 920, 930 has a cut-out portion that generally defines a lower side wall band 921, 931 and an upper side wall band 923, 933. Foldably connecting the lower 921, 931 and upper 923, 933 bands to respective end walls 940, 942, 950, 952 are respective corner tabs 922,932, 924,934. The corner tabs 922, 932, 924,934 respectively form bevelled corners at the intersections of the side walls 920, 930 and end walls 940, 942, 950, 952. The cut-way area also defines a center portion 928, 938 left intact in the side wall 920, 930. A center cell is formed on each side of the carrier by cell bands 925, 935, corner tabs 926, 936 foldably connected to the cell bands and a central cell portion 927, 937 integrally formed with the side wall 920, 930. Riser panels 960, 962, 970, 972 extend between the bottom of the carrier 3 and the handle structure formed by panels 980, 982, 990, 992. A handhold flap 984 is also visible from the view shown. Cut lines between center cell portions of side walls 920, 930 and respective handle structure panels 980, 982, 990, 992 terminate in respective curved cut lines 986, 988, 996, 998. Cut lines between the upper bands 923,933 of respective side walls 920, 930 and corresponding center cell portions terminate in respective curved cut lines 987, 989, 997, 999. In collapsed condition (as shown in FIG. 3) the carrier 3 has nick members 929, 939 strategically located upon cut lines between the side wall and center cell at the bevelled corner tabs. This feature is not evident in the fully erected carrier but can be seen in the blank 906 of FIG. 2 and collapsed carrier 3 shown in FIG. 3. The blank 906 is essentially symmetric about a perforated fold line dividing the handle panels 980, 982, 990, 992, and halves, of the carrier 3 from one another. One of the two bottom wall panels 910, 912 is widthwise greater than the other and for convenience is designated the greater bottom wall 912. The other bottom wall panel is conveniently designated the lesser bottom wall panel 910. Each side wall 920, 930 has a cut-out, or cut-away, area which helps define a lower side wall band 921, 931 with adjacent corner tabs 922, 932 and a top band 923, 933 with adjacent corner tabs 924, 934. Elements for forming a center cell are central cell bands 925, 935, central cell corner tabs 926, 936 and center cell central portions 927, 937 which are integral with the respective side walls 920, 930. Solid nick members 929, 939 connect top side wall bands 923, 933 and respective center cell corner tabs 926, 936. End walls 940, 942, 950, 952 lie adjacent respective side walls 920, 930 connected thereto by respective side wall corner tabs 922, 932, 924, 934. Riser panels are connected to respective end walls 940, 942,950, 952 along perforated fold lines. Support tabs 961, 963,971, 973 for attachment to the bottom wall panels 910, 912 are foldably connected to the lower edges of respective riser panels 960, 962, 970, 972. A suitable carrier for loading by the invention may also have the support tabs connected to the lower edges of respective end walls 940, 942, 950, 952 along fold lines without departing from the scope hereof. The center cell bands 925, 935 are connected along perforated fold lines to the lower portions of respective handle panels 980, 982, 990, 992. Handhold apertures 981, 983, 991, 993 are formed in the respective handle panels 980, 982, 990, 992. Cut lines separating center cell bands 925, 935 and accompanying center cell corner tabs 926, 936 from respective handle panels terminate in curved cut lines 986, 988, 996, 998. Cut lines separating the top bands 923,933 and accompanying corner tabs 924, 934 from respective center cell bands 925, 935 and accompanying center cell corner tabs 926, 936 terminate in curved cut lines 987, 989, 997, 999 in the respective side walls 920, 930. Handhold flaps 984, 994 are connected along perforated fold lines to respective handle panels 980, 990 within the respective handhold apertures 981, 991 thereof. Curved cut lines 986, 987, 988, 989, 996, 997, 998, 999 help direct stress away from strategic termination points of cut lines in the carrier 3.

As previously mentioned, the method and apparatus described herein are particularly suitable for loading carriers having the general characteristics of the type described above. The elements of the carrier 3 enable it to be formed in collapsed condition, shipped, loaded into the apparatus described herein, and then erected and loaded with bottles. Although several types of bottles are suitable for handling and loading by the invention, the invention is particularly useful for loading so-called contoured PET bottles into the carrier 3 illustrated.

Figure 4:
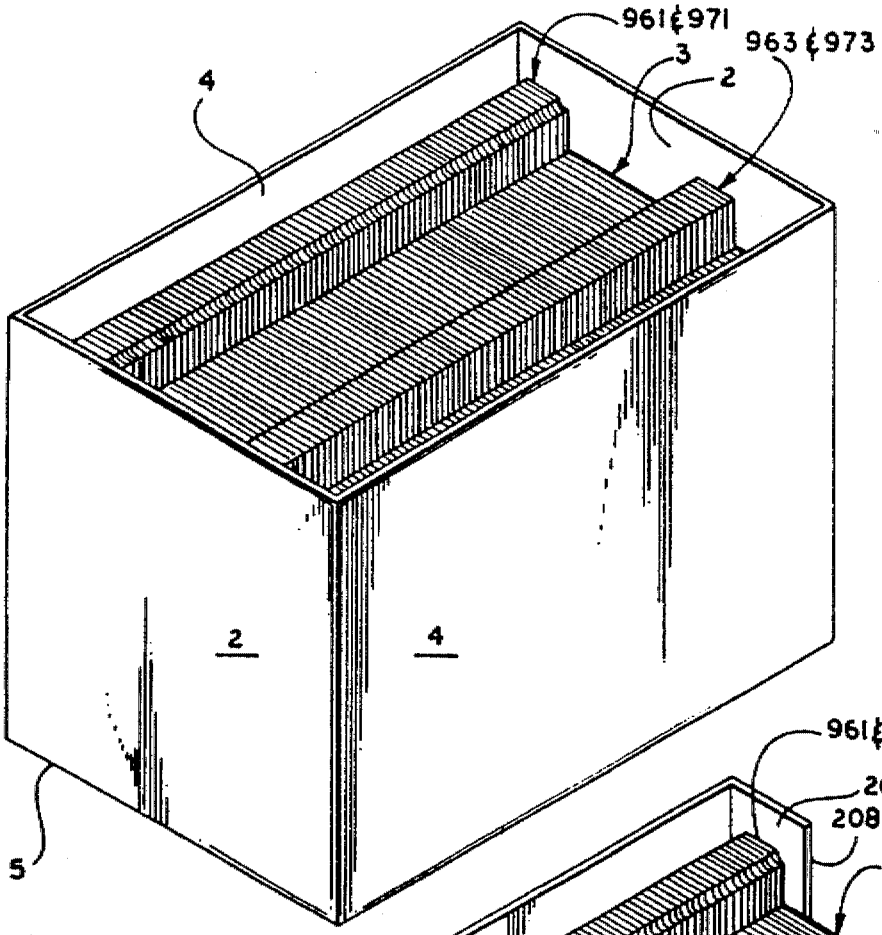
FIG. 4 is an illustration of a container for the carriers of FIG. 1 in the collapsed condition of FIG. 3, configured for use with an automatic carrier loading feature of the hopper of the apparatus of FIG. 5.
Figure 4A:
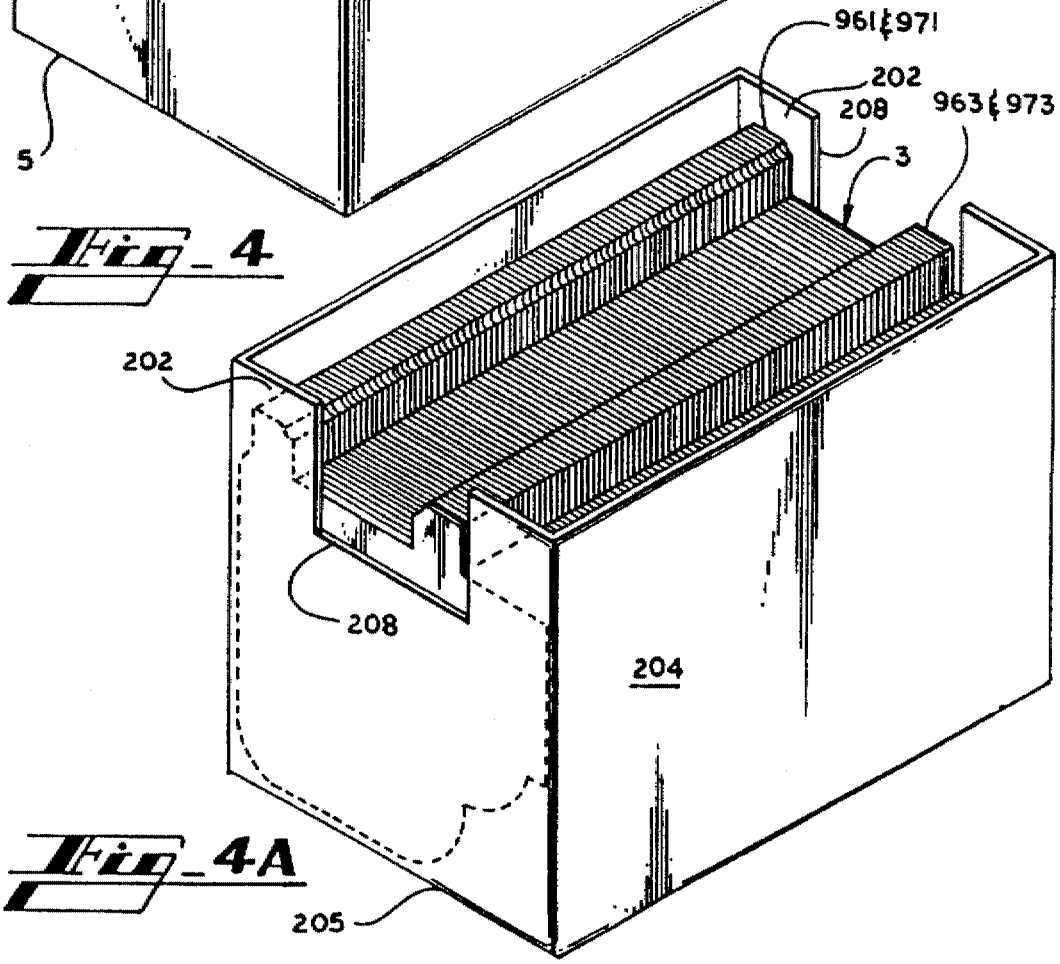
FIG. 4A is an illustration of a container for the carriers of FIG. 1 in the collapsed condition of FIG. 3.

The carrier 3 is received by the apparatus of the invention in collapsed condition, as illustrated in FIG. 3, with the bottom wall panels 910, 912 pivoted upwardly into face contacting relationship with the side walls of the carrier 3. In this condition, the carrier 3 is easily loaded into and subsequently erected and loaded by the apparatus of the invention. However, the support tabs 961, 963. 971, 973 are exposed and may be damaged when the carrier is transported in this condition. The invention includes a suitable means of preparing carriers 3 for loading into the apparatus. As a means for preventing damage to the support tabs 961, 963. 971, 973 of the carrier 3 during shipment to the loading site and to as a means to facilitate loading of the carriers 3 into the apparatus (as described below), the carriers 3 are packaged in a container 5, such as the box shown in FIG. 4, essentially upside-down. In this condition the handle portion is positioned downward and the lower edge is upwardly oriented. The end walls 2 and side walls 4 of the container 5 for the carriers 3 extend above the exposed, protruding support tabs 961, 963, 971, 973 and thereby protect the tabs 961, 963, 971, 973 from damage during shipping to the loading site. The container 5 may be placed in proximity to the hopper 30 of the apparatus and upended to place the carriers 3 into the hopper 30 chute bottom-down, ready for manipulation by the apparatus. Referring now to FIG. 4A, in an alternate version of a container 205 for the collapsed carriers 3, the end walls 202 and side walls 204 again extend above the protruding tabs of the carrier but in addition, each end wall 202 has a slot 208 extending between the upwardly protruding tabs. The slotted container 205 is utilized in conjunction with the automatic loading feature of the hopper described below.

Overview of Apparatus and Method

Figure 5:
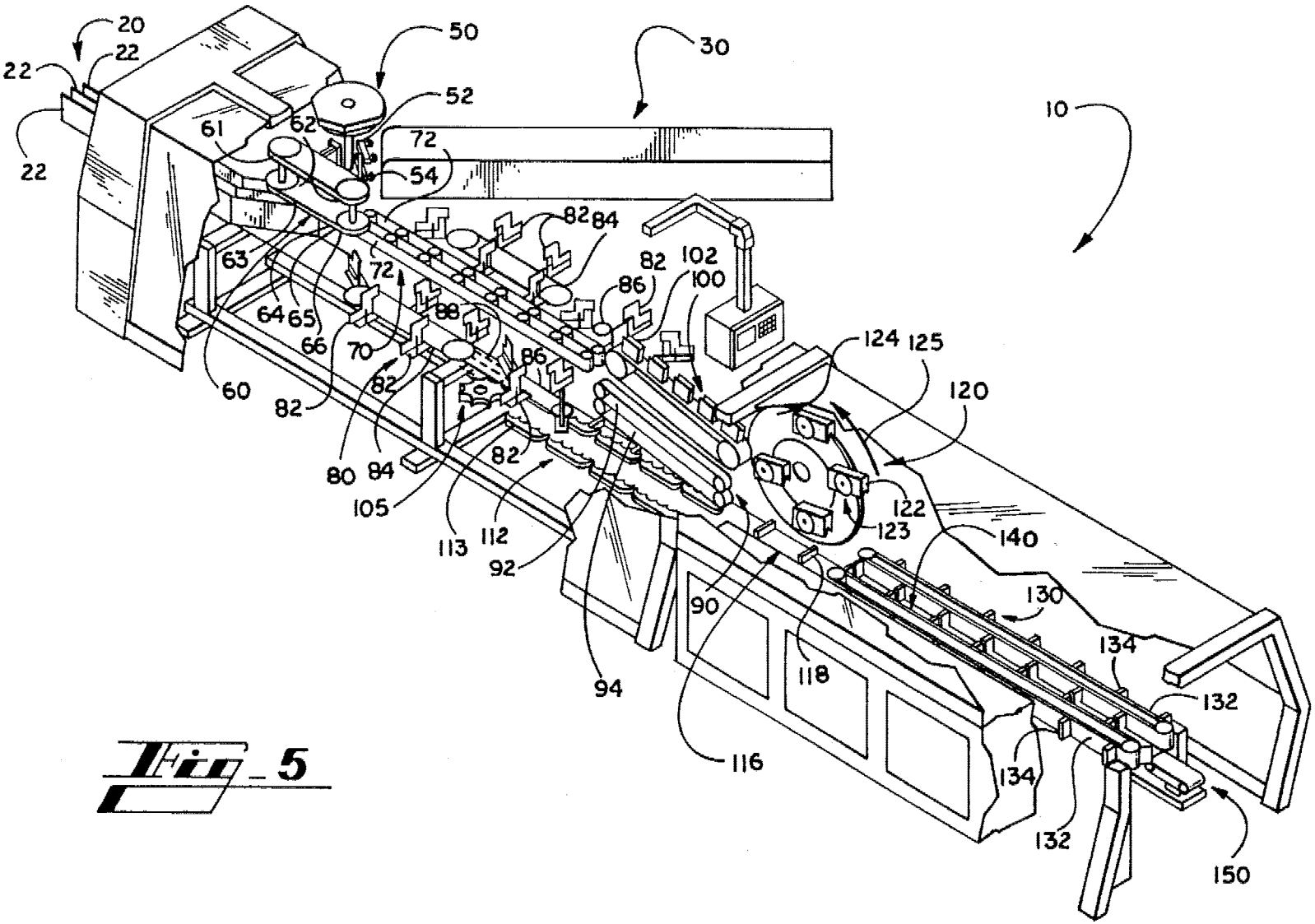
FIG. 5 is a schematic illustration of an apparatus for loading bottom-loading basket-style carriers according to a preferred embodiment of the invention.

Referring first to the schematic illustration in FIG. 5 of the overview of the apparatus 10 according to a preferred embodiment of the invention, the apparatus 10 is constructed upon an elongated frame. In the illustration the direction of movement of bottles 1 and carriers 3 is from left to right. As a general overview, bottles move through the apparatus 10 in two rows along an essentially linear path. As the bottles move along their defined path, carriers (in collapsed condition with bottom wall panels folded upwardly flat against the sides of the collapsed carrier) are moved along the hopper 30 to a point of interface with the carrier feeder 50. The feeder 50 moves individual carriers 3 from the hopper 30 to a timing section 60. A timing-transport section meters out carriers at set intervals and a predetermined rate of speed. In one embodiment, the timing-transport section consists of two assemblies consecutive assemblies. The first segment is a timing section 60 in which each carrier 3 is removed from suction cups 54 of the feeder 50 and conveyed at a predetermined stagger to the downstream components of the apparatus 10. In what may generally be referred to as the transport segment of the timing-transport section a path is defined between a pair of vertically oriented belts. More specifically, this segment is referred to as a nip belt assembly 70. The vertical nip belts 72 are a pair of opposing endless belts that pinch, or "nip," the handle area of each carrier (the carrier's topmost portion) and move the carriers in a defined linear path down the apparatus 10. In an alternate embodiment of the timing-transport section the timing and transport functions are less distinct. In the second embodiment the carriers 3 are engaged through the hand-hole openings in their handles and transported thereby. Timing and transport are achieved by reciprocal movement of a hand-hole insert mounted upon cam-engaging rods. The rods in turn are in slidable engagement with an endless chain. When the carriers 3 are in the hopper 30, they are in collapsed condition with the bottom wall panels 910, 912 pivoted up and lying flat against the sides of the carrier 3. Upon removal from the hopper 30, the bottom wall panels 910, 912 of the carrier 3 fall away from their position flat against the sides of the carrier 3. As a carrier 3 moves through the timing section the bottom wall panels 910, 912 are engaged and pulled outward to open the carrier 3 for loading. As the carriers 3 are being pulled open along the carrier path of the apparatus 10, bottles are moved along in a path beneath the carriers. In the lower path (the bottle path) a star wheel 105 on either side of the apparatus 10 meters a row of bottles 3 into distinct groups for loading. For example, groups of three or four bottles in each row. An endless chain with lugs is one of the means for transporting bottles after they have been metered by the starwheel 105. Bottle grippers 113 (moving in conveying fashion such as upon an endless chain) immediately follow the star wheels 114 and maintain the spacing and alignment of each bottle grouping. As the bottles 3 move further along the length of the apparatus 10 the bottle grippers 113 assure the spacing between bottles 1 and groups of bottles. At the same time, the carriers 3 move to a position whereby each bottom wall panel 910, 912 is received by a pair of downwardly-sloping declination belts 92, 94 & 93, 95. An overhead conveyor mechanism such as an endless overhead chain assembly 100 is aligned over the centrally located handles of the carriers 3 in parallel alignment with the declination belt assembly 90. Block members 102 mounted upon the overhead chain engage the tops of the handle portions of the carriers 3. The declination belt assembly 90 and overhead chain assembly 100 move the carriers 3 forward and downward over the dual-row groups of bottles. The lowering work of the declination belt assembly 90 and overhead chain assembly 100 is completed by the pusher wheel assembly 120. The pusher wheel assembly 120 has block members 122 mounted upon it to push downwardly upon the tops of the handles of the carriers 3, thereby fully lowering the carriers onto respective groups of bottles. As the carriers 3 move from the pusher wheel assembly 120 a package conveyor 130 such as side lugs 134 mounted upon respective opposing endless chains 132 engage the trailing end panel of the carriers 3/packages 7 and push them further along the apparatus 10. As the carriers 3 are moved along by the package conveyor 130, a bottom panel locking section 140 folds carrier support tabs 961, 963, 971, 973 and bottom wall panels 910, 912 into position for attachment of the support tabs 961, 963, 971, 973 to the bottom wall panels 910, 912 and for closure of the bottom of the carrier 3. The bottle panels 910, 912 are drawn together for proper alignment and held in that position while closure of the bottom of the carrier 3 is completed by a rotating punch lock mechanism. The loaded, fully closed carrier is then ejected from the apparatus 10.

Bottle Infeed Conveyor

Referring to FIG. 5, bottles 1 are brought into the apparatus 10 by an infeed conveyor assembly 20. Infeed conveyors typically used in the beverage packaging industry are suitable. In the preferred embodiment illustrated the conveyor assembly 20 has partitions 22 that segregate incoming bottles into two rows. Conveyor means such as an endless belt or chain move bottles through the apparatus 10 for loading into carriers 3. Different endless chains or belts and a combination of different endless chains or belts is used to The carriers 3 and bottles 1 are moved part of the way through the apparatus 10 simultaneously in separate paths, with the carriers 3 proceeding in a path disposed above the path of bottles 1. Then, as will be described further below, the two paths become one when the carriers 3 are moved downwardly over groups of bottles 1.

Hopper Assembly

Referring now to FIGS. 5, 6, and 7, suitable means for making cartons available for loading is provided by a hopper assembly 30. The hopper assembly 30 of the preferred embodiment is essentially a conveyor-driven chute. In FIGS. 6 and 7 the hopper assembly 30 is shown from its "loader" end, that is, the end into which cartons are placed for conveyance to the next assembly of the apparatus 10. In the hopper assembly a pair of opposing side walls 31, 32 form the chute. A pair of opposing belts 37, 38 provide the conveying means for the cartons 3. The belts 37, 38 are moveable by known drive means upon rollers mounted upon a support rod 41, 42, or similar structure. The roller rods 41, 42 are in turn mounted upon trucks 43, 44 or similar structures which, like the side wall trucks 33, 34, are in turn permanently or movably mounted upon a support rod 36. Trucks 33, 34, 43, 44 are attached along the length of the side walls 31, 32 and roller rods 41, 42. Referring now particularly to the elevational view of FIG. 7, therein can be seen the manner in which a collapsed bottle carrier 3 suitable for manipulation by the apparatus 10 and hopper assembly 30 is loaded in the hopper where it is engaged by the side walls 31, 32 and belts 37, 38 of the hopper 30. The hopper 30 is adjustable to accommodate varying sizes of carriers 3, for example, six-pack or eight-pack. The hopper 30 is adjusted by changing the location of the trucks 33, 34, 43, 44 along the support rod 36. The direction arrows denoted 45, 47 illustrate the directions in which the trucks may be moved, inwardly or outwardly, depending upon the size of the carrier 3 to be accommodated. For example, a six-bottle version would be a shorter carrier 3 than an eight-bottle version. The trucks and associated side walls and belts would be placed in closer proximity for the six-bottle carrier than for an eight-bottle carrier. Although it would be possible to move both sides of the walls and roller rods it is simpler to maintain one wall-and-belt set stationary while moving the other set, for instance, the set with which the direction arrows 45, 47 are associated. As can be seen in FIG. 7 the belts are positioned to engage each carrier 3 adjacent the protruding tabs 961, 963, 971, 973. Once the carriers 3 are loaded into the hopper 30 the conveyor belts 37, 38 move the upright collapsed carriers along the hopper side walls 31, 32 to the "exit" end of the hopper 30.

Operation of Hopper

Carriers 3 are loaded into the "loading" end of the hopper with the bottoms of the carriers 3 oriented downwardly. Referring now briefly to FIG. 4, as a means to facilitate loading of multiple carriers 3 into the hopper 30 simultaneously, carriers 3 may be loaded "top-down" into a container 5 so that the container may be simply up-ended to dump the carriers 3 "bottom-first" into the hopper 30. Packing the collapsed carriers 3 for shipment in this up-side down manner also enables the container 5 to help protect the tabs 961, 963, 971, 973 from damage during transport. When packaged up-side down in this manner the carriers 3 are able to be conveniently shipped without damage to the support tabs and then easily loaded into the hopper 30.

In order to provide the greatest hopper length but still conserve the amount of floor space consumed by the apparatus the hopper chute is angularly aligned with respect to the main portion of the elongated apparatus 10.

Carrier Feeder

Referring momentarily to FIGS. 5, as previously noted, the layout of the apparatus is generally linear with bottles 1 and carriers 3 being moved along separate linear paths, one over the other, part of the way through the apparatus 10, and then packages formed of the loaded carriers moving along a single path the rest of the way through the apparatus 10. Referring now to FIGS. 5 and 8, the carrier feeder 50 removes carriers 3 from the hopper 30 and passes them on to elements in a linear carrier path disposed over the bottle path. The carrier feeder 50 is a rotary type assembly having three spaced-apart suction-cup support stations 52. Each cup support station 52 supports suction cups 54 for adherence to and removal of a collapsed carrier 3 from the exit end of the hopper 30. The stations 52 rotate as indicated by the rotational direction arrow 57 about an axis 59. For example, the stations 52 may be made to rotate about the axis 57 slidably by means of a support tie rod 53. In a suitable arrangement, each tie rod 53 has one end affixed to a member at the axis 59 and the other end attached to the respective support station 52. The preferred embodiment contains three cup support stations 52, however, as few as one and more than three may be used. Three stations effectively move the carriers 3 in a horizontal path to the timing section 60 or 260 of the apparatus 10. The actual suction cups 54 are not shown in FIG. 8 in order to more clearly illustrate other features. However, nozzles 55 upon which cups 54 are positioned are shown. The suction cups 54 are spaced apart so as to engage the carrier 3 at strategic peripheral points for handling. Suction, or a vacuum, for operation of the suction cups 52 is provided by typical pneumatic components. The guide 56 relates to a timing feature used to remove carriers 3 from the suction cup support stations 52, and will be explained in greater detail below.

Timing-Transport Section

Alternate versions of the timing-transport section are described. The first version is described referring to FIG. 5. As previously mentioned, the timing-transport section moves carriers 3 from the feeder 50 to downstream components of the apparatus 10. The timing-transport section staggers the carriers 3 a predetermined distance apart and begins their travel at a predetermined rate of speed. This timed spacing of carriers 3 causes the carriers 3 to begin synchronized aligned movement with respective groups of bottles 1 as the carriers 3 and bottles 1 move downstream.

Timing-Transport Section: First Embodiment

Figure 9:
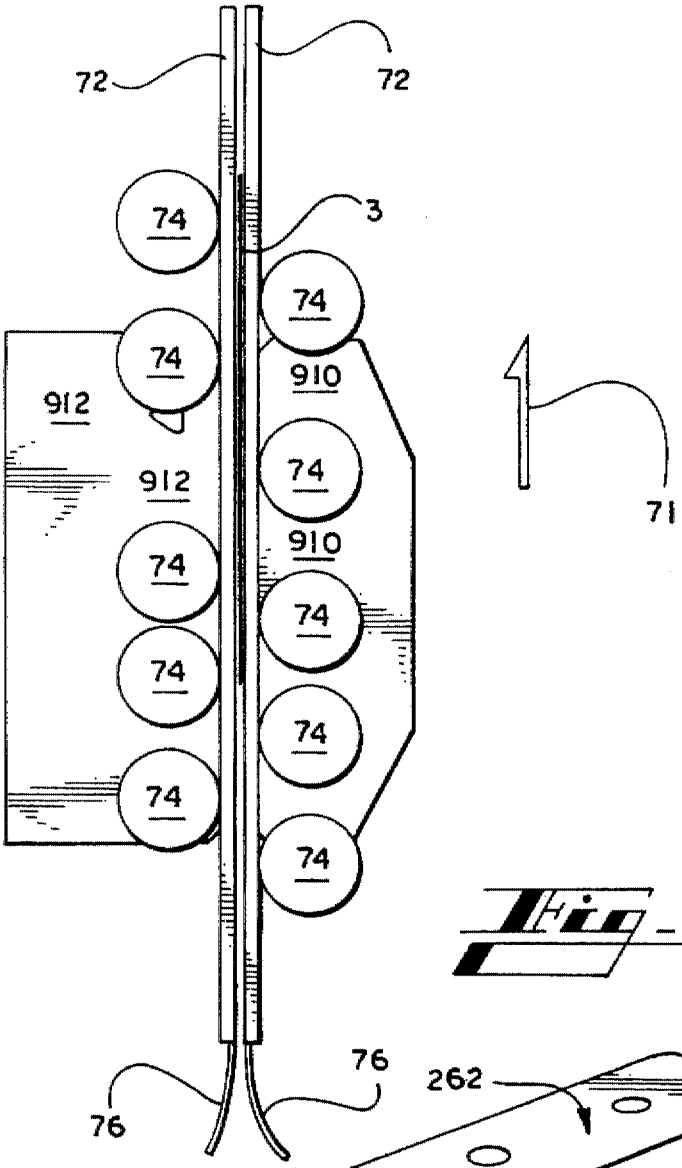
FIG. 9 is a plan illustration of a portion of a nip belt assembly of the apparatus of FIG. 5 engaging a carrier.

The first version of the timing-transport section achieves timing and transport in two distinct segments, namely, a timing assembly 60 and a transport section for convenience herein referred to as a nip-belt assembly 70. The timing assembly 60 has conveyor-driven carrier support fingers for engaging and moving carriers 3 at predetermined intervals and inserting the carriers into nip belts at the predetermined intervals. The carrier support conveyor 60 is a pair of an upper 61 and a lower 63 endless timing chain. Each timing chain 61, 63 contains respective sets of lugs, or fingers, that engage portions of a collapsed carrier 3 as the carrier is released by the suction cups 54 of the feeder 50. The upper timing chain 61 has a series of upper engagement lugs 62 one of which engages the trailing edge of the handle portion of an engaged carrier 3. In the preferred embodiment illustrated an upper engagement lug 62 engages the carrier 3 at the intersection of the handle portion and the wall panels. The corner formed at the intersection provides a stable point of engagement. The lower timing chain 63 has a set of lower engagement lugs 64, 65, 66 that work in tandem with each upper engagement lug 62 of the upper chain 61 to hold the carrier 3 steady and guide it into the nip belt assembly 70. Although several combinations of lower engagement lugs in the set would be effective, in the preferred embodiment illustrated there are three lower engagement lugs 64, 65, 66 in each set. All three lugs 64, 65, 66 support the carrier from the bottom. The trailing lower engagement lug 66 is especially effective in helping push the collapsed carrier 3 forward. The nip belt assembly 70 receives collapsed carriers 3 from the feeder 50 and timing assembly 60. The nip belt assembly 70 moves carriers 3 along at the predetermined spacing initiated by the timing section 60 as the bottom panels 910, 912 of the carrier 3 are gripped and moved outwardly to open the bottom of the carrier 3 for loading. Referring now to FIGS. 5 and 9, the nip belt assembly 70 has a pair of endless belts 72 mounted upon respective elongated rods of rollers 74. The belts 72 press together in an elongated vertical plane whose direction of movement 71 with respect to an engaged carrier 3 is downstream of the apparatus. The topmost portion of the handles of the carriers 3 are sandwiched between the belts 72 and translated along the path between the moving belts 72. An upper belt guide 76 directs the top portion of handles of carriers 3 into the pathway between the belts 72. The lower belt guide 78 extends along the length of the belts 72. The opening to the lower belt guide 78 directs the downwardly-extending support tabs 961, 971, 963, 973 of carriers 3 into the guide 78. Referring now also to FIG. E+3, as the top portion of the handles of carriers 3 are pinched and translated along by the belts 72, the support tabs 961, 971, 963, 973 travel along through the lower belt assembly guide 78.

Timing-Transport Section: Alternate Embodiment

Figure 11:
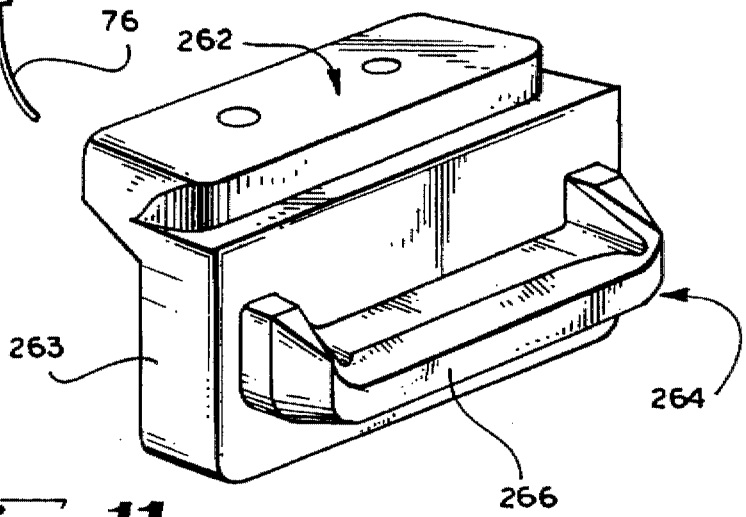
FIG. 11 is an isometric illustration of a handhold-aperture insert for the assembly of FIG. 10.
Figure 13:
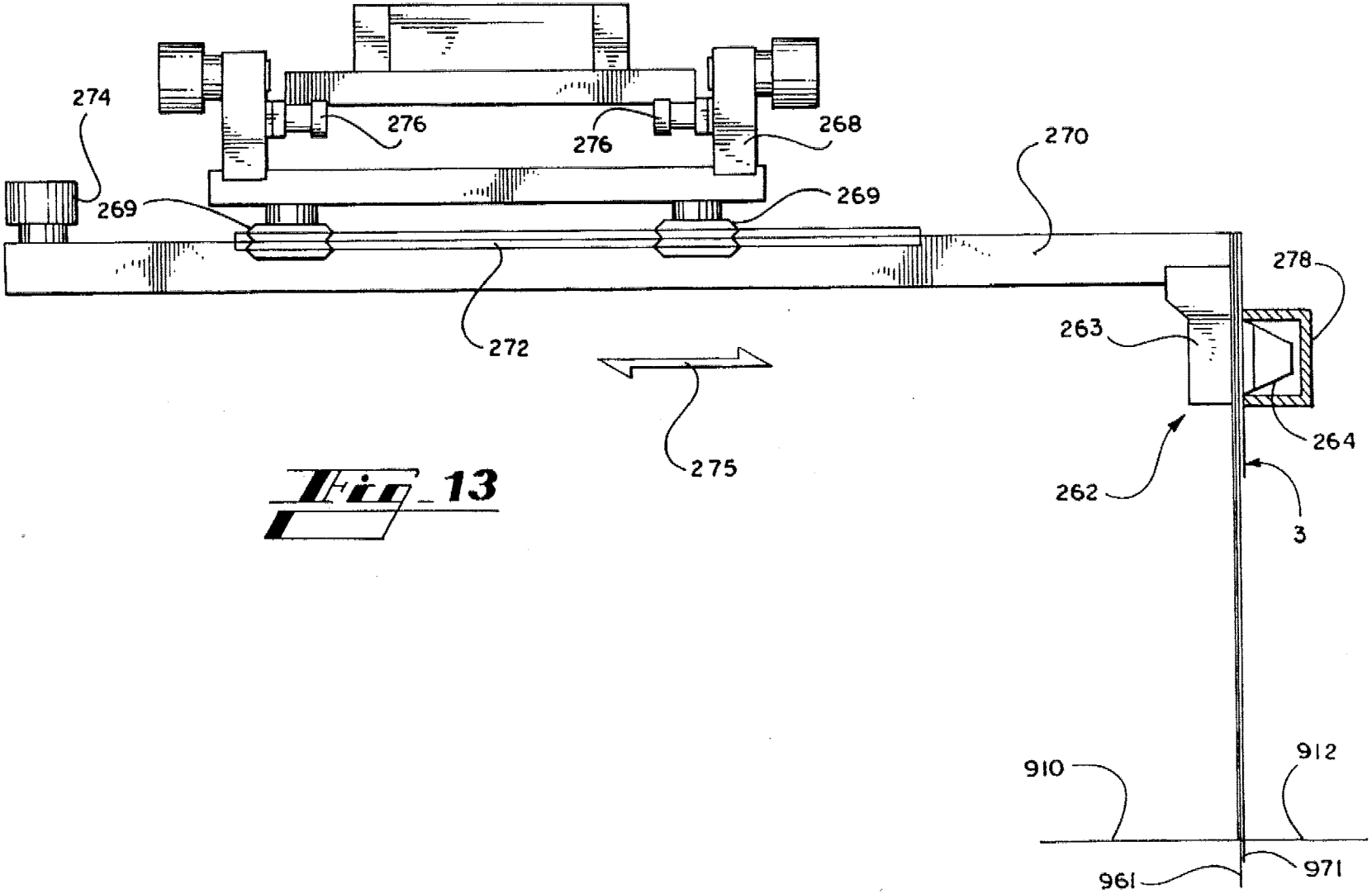
FIG. 13 is side view through a section of the handhold-aperture insert assembly of FIG. 10 with the insert seated in the handhold aperture of a carrier and with a stop-guide rail of the apparatus facilitating seating of the insert with the carrier.

The alternate embodiment employs several features distinct from the immediately preceding described embodiment of a timing-transport assembly to achieve interval spacing and initiate timed transport of the carriers. As in the previously-described embodiment, the alternate embodiment engages the carriers 3 in the collapsed condition shown in FIG. 3. Referring now to FIG. 10, the alternate embodiment utilizes an assembly of chain-mounted insert members 260 to both define separation between carriers 3 and to transport the carriers in synchronous timing with the downstream elements of the apparatus. Referring now to FIG. 11 and FIG. 12, therein are respectively illustrated a handhold-aperture insert 264 and one side (the other side being identical) of handhold aperture 983 of the handle portion of a carrier 3. The handhold aperture 983 is U-shaped with a U-shaped flap 984 foldably extending from its upper portion. The insert 264 has a tapered U-shaped projection that corresponds to the shape of the handhold aperture 983 and flap 984. In the upper corners of the apertures 983 the spacing between the handhold flap 984 and the sides of the aperture 983 may be slightly elongated to provide a more stable point of engagement. The corresponding portion in the upper corners of the U-shaped projection of the insert 262 have matching dimensions. The front portion 266 of the inner bottom surface of the insert 262 is bevelled to more easily accommodate the handhold flap 984. Referring now again to FIG. 10, the inserts 262 are mounted upon end less chains 276 that travel in the direction indicated by the direction arrows 277. The rods 270 upon which the inserts 262 are mounted are in turn mounted within rollers 269 upon trucks 268 that travel the closed cyclical path of the endless chains 276. During the bottom of the cycle of the run of the endless chains 276, the rods 270 with mounted inserts 262 translate outwardly (transversely) of the chains 276 toward stop-guides 56 and 278. A suitable mechanism for causing transverse translation of the rods 270 is the use of a cam follower (shown in FIG. 13) on the rod 270 which interacts in known manner with a camming bar or rail to achieve move at predetermined points along the rail. V-shaped rollers 269 cooperate with a roller-engagement member having a corresponding V-shaped edge enable the rods 270 to be reciprocally translatable as denoted by the direction arrows 275 shown in FIG. 13. Referring now also momentarily to FIG. 8, the insert 262 first engages a carrier 3 that has been engaged by the carrier feeder 50 and rotated so that its station 52 faces the insert 262 that translates outwardly first. The stop-guide 56 mounted upon each station 52 of the feeder provides support for the handle portion of the carriers 3 when the insert 262 attempts to seat itself. The insert 262 and the stop-guide 56 of the feeder cooperate to promote full seating of the insert within the handhold aperture of the carrier in the same manner as the stop-guide rail 278 interacts with the insert 262 to provide a steadying counter force as the chain-mounted inserts 262 transport carriers 3 down stream. FIG. 13 is illustration of the insert 262 engaging the handle of a carrier 3 as the insert 262 is guided and the carrier 3 is urged toward the insert 262 by the stop-guide rail 278. The cooperation and interaction between the insert 262, carrier 3 and stop-guide 56 of the feeder would appear the same. Referring now again to FIG. 10, once the carrier 3 has been engaged by the insert 262 at the feeder 50, the insert 262 translates downstream into the channel of the stop-guide rail. For further clarity in understanding the features discussed reference may be made to the elevational view of FIG. 14 which looks into the projection, or nose, 264 at the front of the insert 262.

Bottom-Panel Grippers

Figure 15:
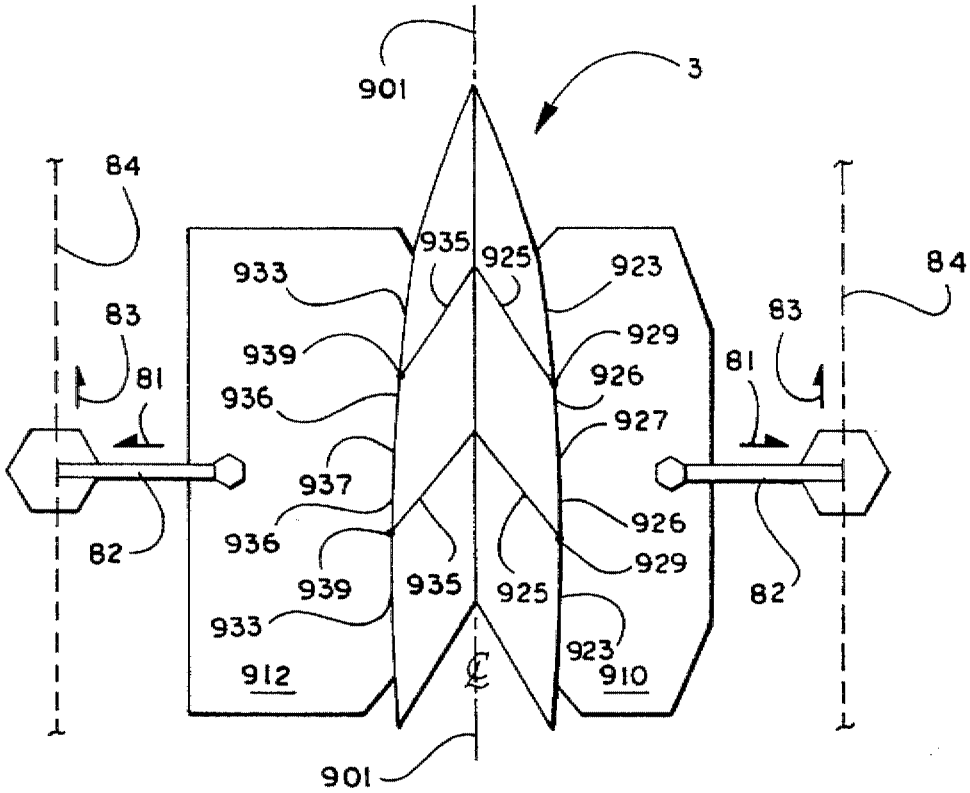
FIGS. 15 and 16 are schematic representations of the panel-gripper assembly of the apparatus of FIG. 5 in operation.
Figure 16:
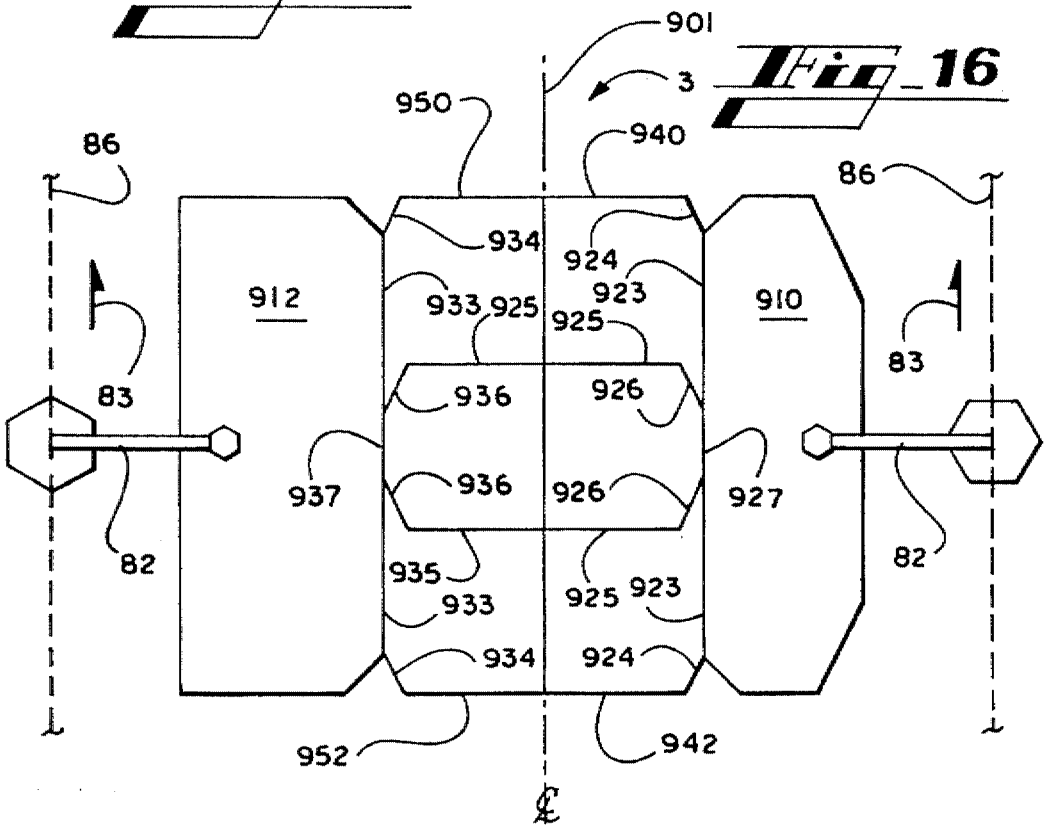
Figure 17:
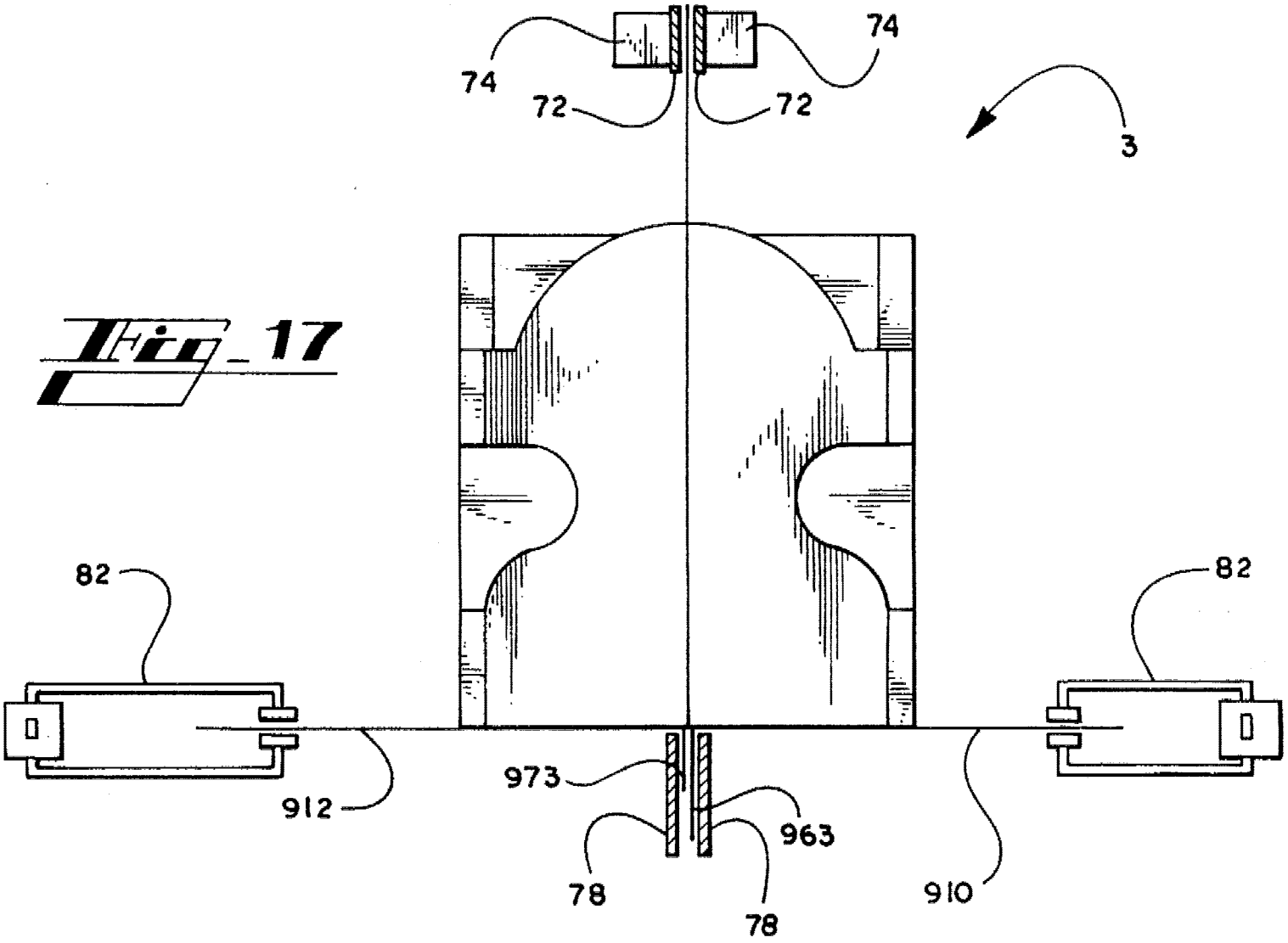
FIG. 17 is an end elevational illustration of the nip belt assembly and panel-gripper assembly of the apparatus of FIG. 5 engaging a carrier.

Referring to FIG. 5, in a panel-gripper assembly 80, panel-grippers open the collapsed carrier 3 in preparation for loading. As the carriers 3 move through either of the alternate versions of a timing-transport section (which are described above) carrier-panel grippers 82 moving on conveyors in a parallel path beneath the timing section grasp the bottom panels 910, 912 and pull them outward to open the carrier 3. Each carrier gripper 82 is a clamp that grasps a respective bottom panel 910, 912. Referring now also to FIGS. 9 and 13, a carrier 3 is shown in a condition to be grasped by grippers 82. Referring now again particularly to FIG. 5, the grippers 82 are mounted upon two sets of conveyors (endless chains) 84, 86. Each set of chains 84, 86 is a pair of opposing endless chains that are respectively positioned on each side of the collapsed carriers 3 moving through the timing section. Referring now also to FIGS. 15 and 16 the opening motions of the elements of the gripper assembly are schematically illustrated. The grippers 82 on both sets of gripper chains 84, 86 move outwardly of the centerline 901 of the carrier 3 in the direction indicated by the direction arrow denoted 81. At the same time, each chain 84, 86 rotates in the downstream direction indicated by direction arrow 83. The grippers 82 and chains of the first set of chains 84 open carriers 3 by pulling outwardly upon the bottom panels 910, 912 of the carriers. The first set of chains 84 and grippers 82 opens carriers 3 from the fully collapsed condition of FIGS. 9 and 13 to an open condition. The chains 84 in the first set of chains 84 move at a greater speed than the relative speed of the carriers 3 as they are moved by the transport mechanisms of either the nip belts 72 or the inserts 262. (In turn, the movement of the carriers 3 by the timing-transport section of the apparatus is in timed sequence with the movement of the bottles in a parallel path below the carriers.) As can be seen in FIG. 15, the collapsed carrier 3 is folded in a collapsed condition in manner resembling the bellows of an accordion wherein the front portion of the collapsed carrier projects outwardly and the rear portion is folded inwardly. The greater relative speed of the first set of chains 84 enables the panels 910, 912 to be pulled forward faster than the carrier 3 itself is moving forward. This movement enables the carrier to become opened in a squared-up condition wherein the bottom panels 910, 912 "catch up" with the center portion of the carrier 3. After the carrier 3 has been erected in the first gripper chain 84 section the panel grippers 82 of the second set of gripper chains 86 engage the bottom panels 910, 912 of the carrier 3 and pull the carrier 3 open further to the maximally-opened condition illustrated in FIGS. 16 and 17. The second set of chains 86 of the gripper assembly also passes opened carriers 3 on to the next carrier-handling portion of the apparatus 10, namely, the carrier lowering section 90. The grippers 82 and chains 84 of the second set of gripper chains do not move at a greater relative speed than the carrier transport mechanism but move in synchronous downstream motion (as indicated by the direction arrow 83) with the nip belts 72 or inserts 262. The grippers 82 continue to hold the respective bottom panels 910,912 outward during movement. FIGS. 16 and 17 illustrate the end of carrier 3 opening in which the carrier 3 is fully opened and ready to be passed on to the declination belt assembly 90. FIG. 17 is an elevational illustration of a fully-opened carrier 3 engaged by elements of the nip belt assembly 70 and panel grippers 82. Referring now momentarily to FIG. 5, a pair of opposing conveyors in the form of endless chains 88 assist in passing opened carriers 3 from the first set of chains 84 to the second set of chains 86. As carriers 3 leave the first set of chains 84, lugs 89 mounted upon the chains 88 engage the front and rear of open carriers to help them maintain their opened position as the bottom panels 910, 912 are again grasped by the grippers 82 of the second set of chains 86.

Figure 18:
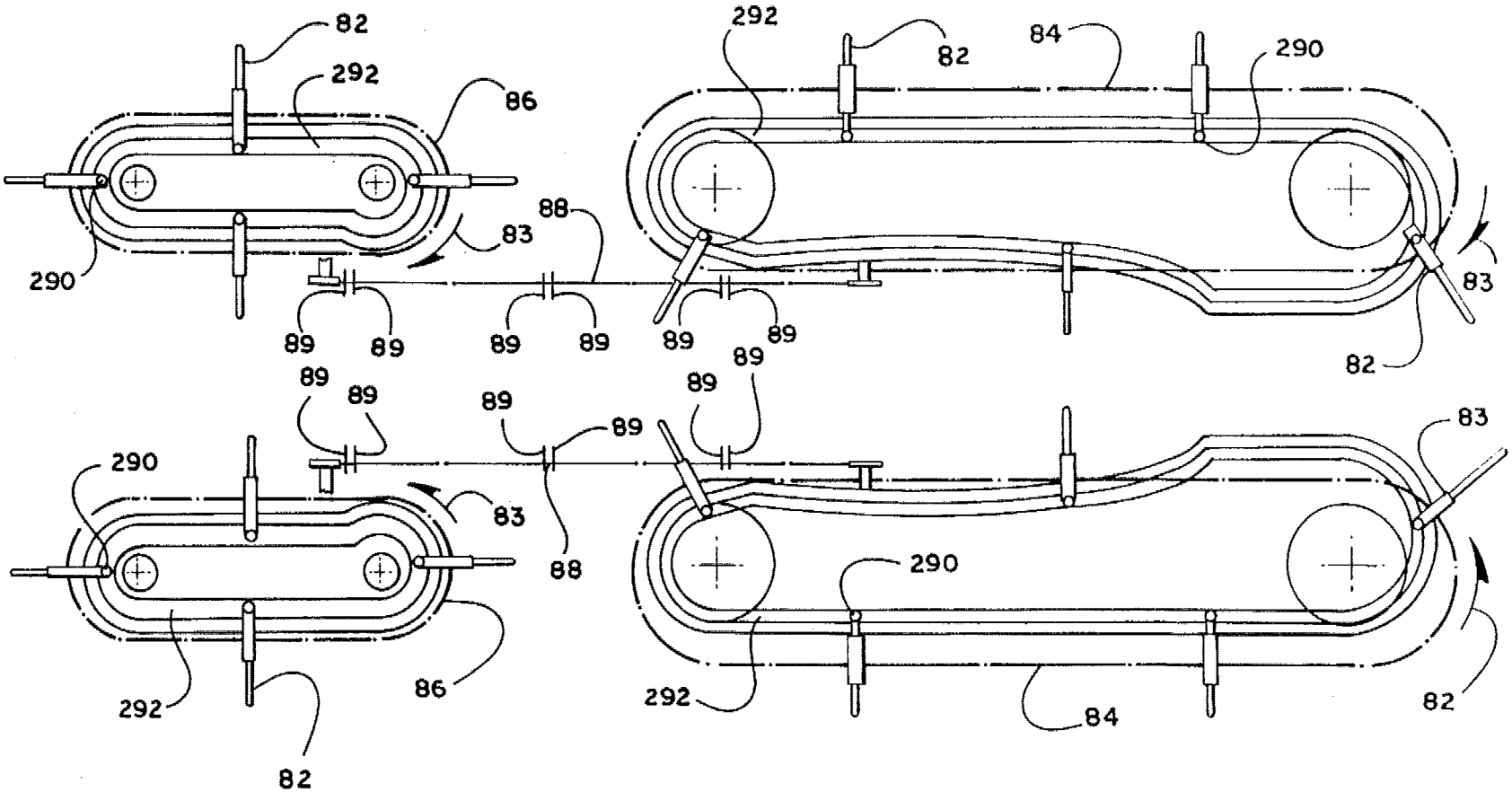
FIG. 18 is a plan layout of the panel-gripper assembly of the apparatus of FIG. 5.

A plan layout of the grippers 82, chains 84, 86, 88 and lugs 89 is illustrated in FIG. 18. In the preferred embodiment of the invention, as the grippers 82 travel the closed circuit defined by the gripper chains 84, 86 they are caused to translate outwardly toward the opposing set of grippers and then inwardly away from the opposing set of grippers (and thus outwardly of the centerline 901 of the carriers) through utilization of a cam follower mounted upon each gripper 82 which travels in a camming groove, or track, 292.

Figure 19:
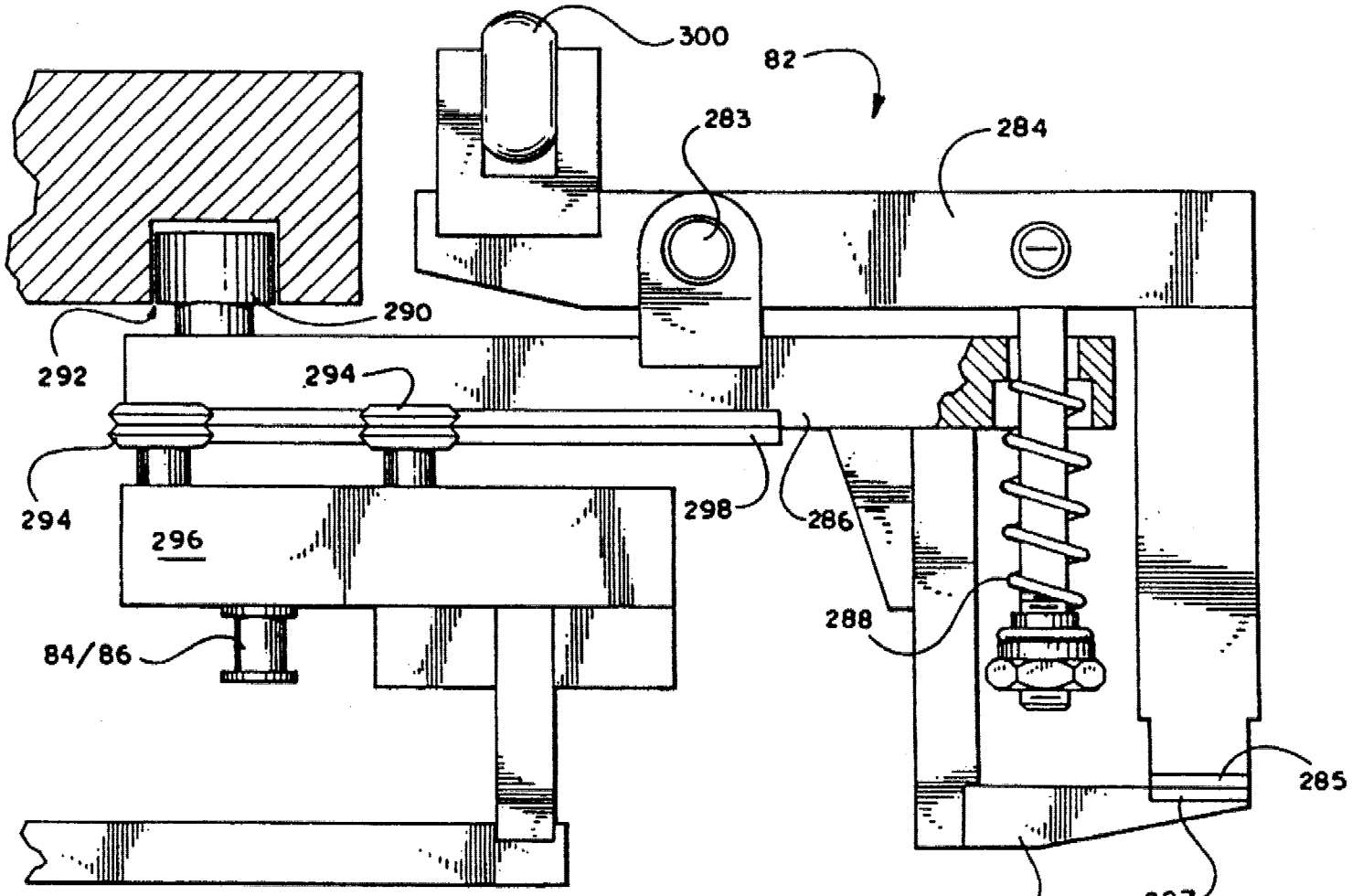
FIG. 19 a side elevational illustration of a panel-gripper in engagement with a camming track of the of the apparatus of FIG. 5.

Referring now also to FIG. 19, the structure of a panel gripper 82 suitable for use with the panel-gripper assembly described above is described in greater detail. In the gripper 82 an upper arm 284 and a lower arm 286 form clamping jaws that are pivotally 283 connected to one another and meet at a clamping point where each arm 284, 286 terminates in a respective pad 285, 287. Each gripping pad 285, 287 is made of a substance that has a high coefficient of friction relative to the smooth surface of carrier. A suitable substance is rubber. The pads 285, 287 may also have a corrugated surface or a surface otherwise containing ribs or other protruding structures to enhance friction. The arms 284, 286 are spring-biased 288 in a closed, clamping position for the gripper 82. The arms 284, 286 are mounted upon a truck 296 which in turn is mounted upon and transported by a gripper chain 84 or 86. The arms 284, 286 are translatable with respect to the truck 296 through the cooperation of V-shaped rollers 294 mounted on the truck and a roller engagement member 298 which has V-shaped edges and which is attached to the lower gripper arm 286. A cam follower 290 is attached to the lower arm 286 and rides within a camming groove (or track) 292 that defines the translational movement of the arms 284, 286.

Figure 20:
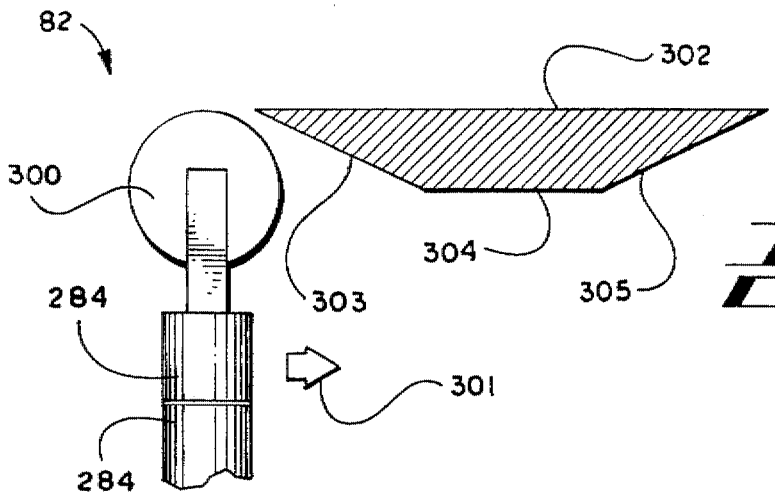
FIGS. 20, 21 and 22 are illustrations of the cooperation between the opening rollers and opening ramp member of the panel-gripper assembly of the apparatus of FIG. 5.
Figure 21:
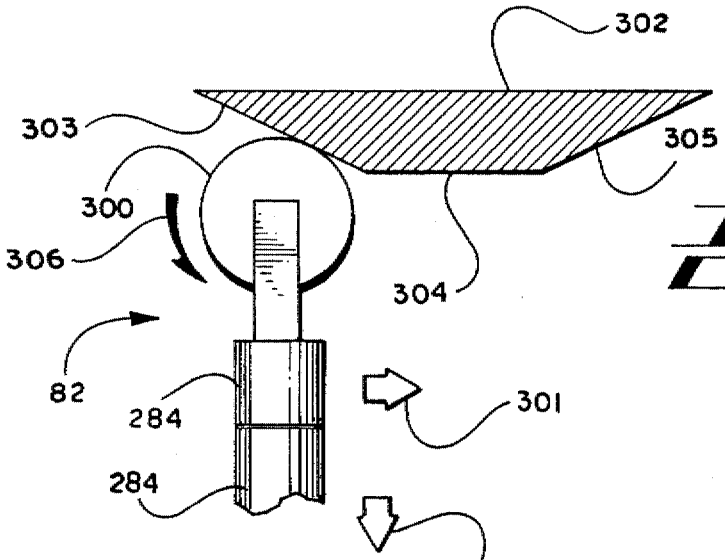
Figure 22:
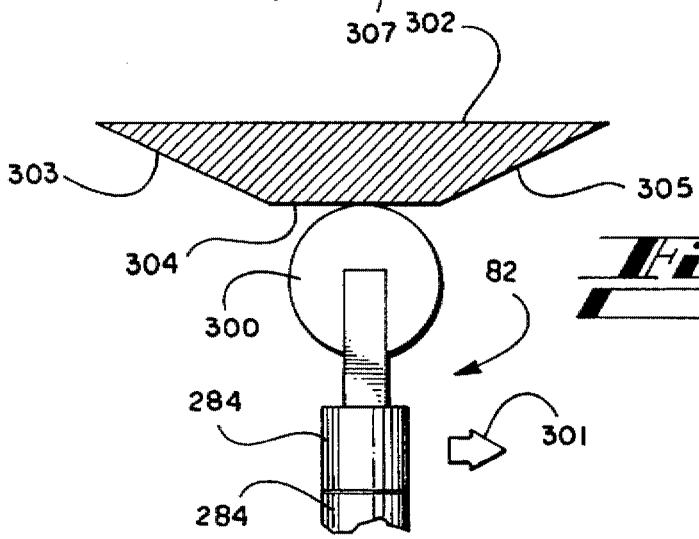

The manner in which the gripper's 82 upper arm 284 is made to pivot to open and close with respect to the bottom arm 286 to clamp and release the bottom panels 910, 912 of the carrier 3 is described with reference to FIGS. 20, 21 and 22. FIGS. 20, 21 and 22 are representations of the movement of the gripper 82 as it is transported by its mounting chain 84 or 86. The view is from a vantage point looking at the front end of the gripper 82 toward the rear of the upper arm 284 where the opening roller 300 is attached. As the gripper is transported in the directed indicated by the arrow 301 the rear of the upper arm 284 is pushed downward, held down for a period and subsequently allowed to return to its upwardmost position through interaction of the opening roller 300 with the opening ramp member 302. The opening ramp member is a plate, bar or other structure having a cross-sectional configuration defining a leading downwardly-inclined ramp 303 and ending in an upwardly-inclined trailing ramp 305. A flat portion 304 may be inserted between the two ramps 303, 305 to maintain the jaws (arms 284, 286) of the gripper 82 open for a short period. FIG. 20 illustrates the relative position of the opening roller 300 and opening ramp member 302 prior to contact between the roller 300 and leading ramp 303. In FIG. 21, as gripper 82 travels in the direction 301 shown, the roller 300 is engaged by the leading ramp 303 and rotates 306. The upper arm 284 is thus pushed downward 307 opening the jaws of the clamp. If the ramp 302 contains a level portion 304 the jaws of the gripper 82 are held open during engagement of the roller 300 with the level portion. Travel of the roller 300 upon the trailing ramp 305 closes the jaws of the gripper 82.

Referring now momentarily to FIG. 2 and the schematic illustration of FIG. 15, it is noted that the carrier 3 may contain nick members 929, 939 to promote opening of the collapsed carrier in a particular fashion. The nick members 929, 939 are weak connecting members extending between respective center cell corner tabs 926, 936 and upper side wall bands 923, 933. The nick members 929, 939 cause separation of the upper side wall bands 923, 933 from the center cell bands 925, 935 to be delayed. The delay causes the angles between the center cell bands 925, 935 and respective center cell corner tabs 926, 936 to more sharply form in the erected carrier.

Bottle Metering and Transport

Figure 23:
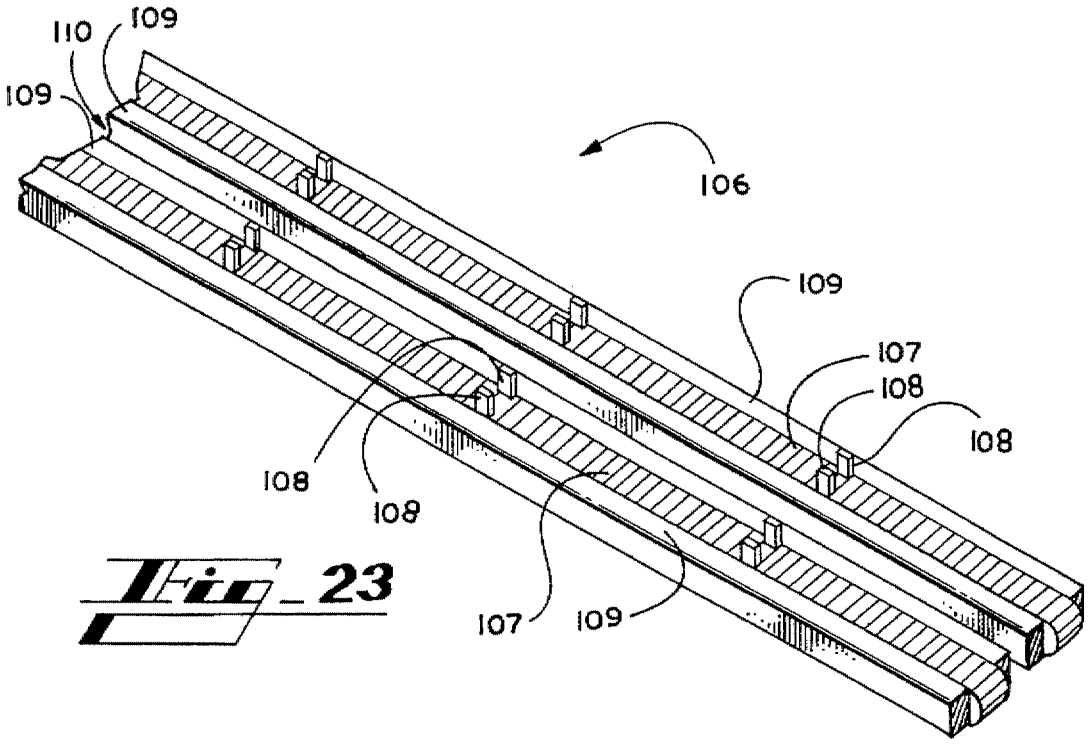
FIG. 23 is an isometric illustration of the bottle transport conveyor of the apparatus of FIG. 5.

As previously mentioned, a starwheel 105 meters bottles from the bottle infeed conveyor into groups for loading into the carriers. After metering, timed, spaced transport of the groups of bottles is achieved through use of a conveyor 106 which travels under the bottles and a bottle-gripper conveyor 112 which engages the sides of the bottles. Referring now to FIG. 23, a bottle transport conveyor 106 has a spaced-apart pair of endless chains 107 upon which bottle lugs 108 are mounted and each of which is flanked by a pair of bottle support rails 109. The rails 109 serve as ledges which help support the outer periphery of the bottom of bottles. The lugs 108 engage the rearmost bottle in each column of a bottle grouping. Although a single lug may be used to engage the rearmost bottle in a column, paired sets of lugs 108 allow more stable contact with bottles because two points on the bottle are contacted rather than one. The slot, or spacing, 110, extending longitudinally between the chain structures provides a travel path for the tabs 961, 971, 963, 973 when carriers are lowered onto groups of bottles. This aspect will be explained in greater detail below.

Figure 25:
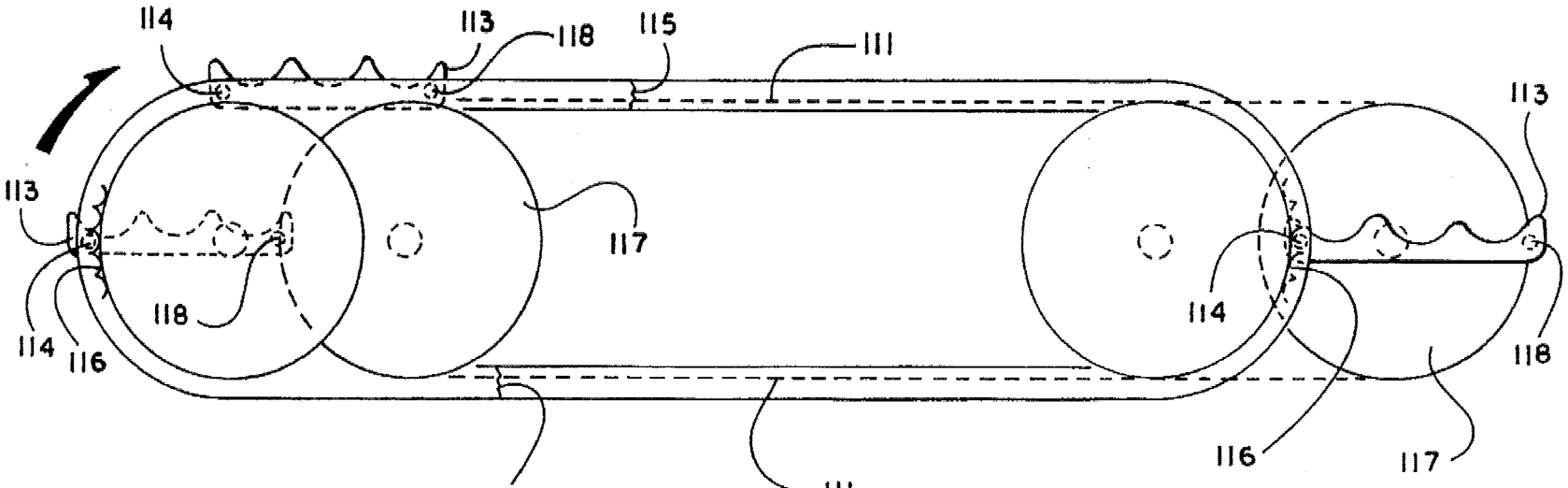
FIG. 25 is a top plan illustration of a bottle-gripper conveyor of the apparatus of FIG. 5.
Figure 24:
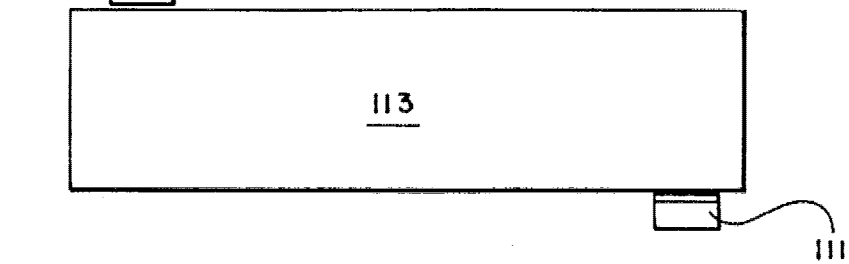
FIG. 24 is a rear elevational illustration of a bottle gripper of the bottle-apparatus of FIG. 5.

Referring now to FIGS. 5, 24 and 25, bottles are maintained in the groupings and spacings metered out by the starwheel 105 by means of a pair of bottle-gripper conveyors 112. The bottle-gripper conveyors 112 work in conjunction with the bottom-engaging bottle conveyor described immediately above to transport bottles. Each bottle-gripper conveyor 112 has bottle grippers 113 mounted upon an endless chain 111. Each bottle gripper 113 is a block-like member with a series of adjacent C-shaped cavities for receiving bottles 1. The number of C-shaped cavities corresponds to the number of bottles to be contained in each column of the carrier 3. For example, a carrier for six bottles would have three bottles per column and a carrier for eight bottles would have four bottles per row. The invention employs a single chain 111 to circulate the bottle grippers 113 while maintaining the grippers 113 in a constant orientation facing the center of the apparatus 10. Referring now particularly to FIG. 24, from a rear elevational view of a gripper 113, each gripper 113 has a cam follower 114 mounted on its upper surface at an end of the gripper 113 opposite an end which is pivotally attached to the bottle-gripper chain 116. Referring now particularly to FIG. 25, the lower portion of each gripper 113 is pivotally attached to the gripper chain 111. Each bottle-gripper cam follower 114 rides in a camming track (or groove) that maintains the inward-facing orientation of the bottle-grippers 113 as the grippers 113 travel the closed path defined by the chain 111. A sprocket wheel 116 guides the cam follower 114 as the chain 111 rotates the gripper 113 around the chain wheel 117. The sprocket wheel's 116 engagement of the cam follower 114 together with the pivotal connection 118 of the follower 113 to the chain 111 maintain the gripper's 113 orientation as the gripper chain 111 carries the grippers around the chain wheel 117.

Carrier Lowering Section

Figure 26:
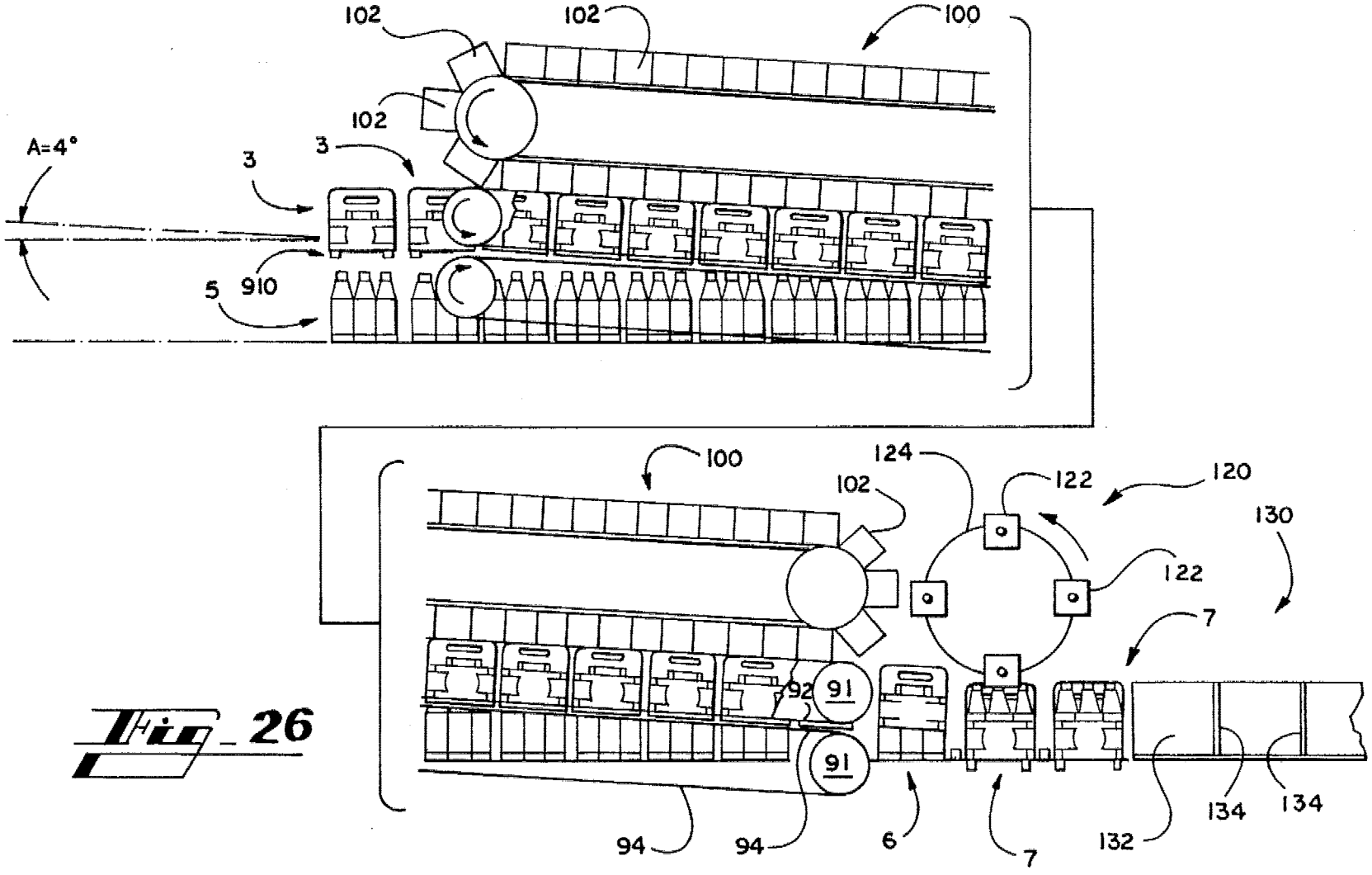
FIG. 26 is a side elevational view of declination and seating assemblies of the apparatus of FIG. 5.

After opening, carriers 3 are lowered onto groups of bottles 1 moving in a parallel path beneath the path of the carriers 3. With reference now to FIGS. 5 and 26, carrier lowering is accomplished through the combination of a declination belt assembly 90 and an overhead declination block assembly 100. When the erect carrier 3 leaves the nip belt 70 and gripper 80 assemblies it is upright with its bottom panels 910, 912 extended outwardly of a center line 901 of the carrier 3. As the erect carrier 3 leaves the nip belt assembly 70 and the grippers 82 mounted upon the second gripper chain 86, it is directed toward the declination assembly where the extended bottom panels 910, 912 are respectively received by left and right opposing pairs of declination belts 92, 94 and 93, 95. Referring now generally to FIGS. 5 and 26 but more particularly to FIGS. 27 and 28, the pairs of belts 92, 94 and 93, 95 of the declination belt assembly 90 are spaced apart so that the carriers 3 may pass between them. For reference, one pair of upper 92 and lower 94 belts is considered the "right" declination belts while the opposing upper 93 and lower 95 belts are considered the "left" pair. Each of the four belts 92, 93, 94, 95 is an endless belt. The spacing shown between the facing surfaces of each pair of belts is for illustration purposes. The facing surfaces of each pair of belts 92, 94 and 93, 95 belts are disposed closely enough so that the panels 910, 912 of the carrier 3 are wedged between each pair of moving belts. The carriers 3 are thus translated along the apparatus 10 by the moving belts. Although only the general structure of the belts assembly 90 is shown it can be appreciated that means of endless belt movement commonly used by those skilled in the art are employed. For example, the use of a circular roller mechanism 91 disposed at the ends of the belt runs with additional rollers disposed between the ends of the runs to maintain opposing belts in surface-to-surface contact (as is illustrated in FIG. 9 with reference to the rollers 74 in the nip belt assembly 70). The belts' 92, 94 and 93, 96 movements are in synchronization with the movement of the bottle-group conveying mechanism (that is, the bottle-gripper conveyors 112). Each carrier 3 is received by the declination belts such that each carrier 3 overlies a group of bottles 5. Referring now particularly to the side elevational view of FIG. 26, an optimum angle of declination of the pairs of belts 92, 94 (and 93, 95 which are parallel to 92, 94 but not visible in FIG. 26) and the horizontal plane of the groups of bottles 5 is shown as an angle denoted "A" of 4 degrees. The angular orientation of the declination belts 92, 94 and 93, 96 causes the carriers 3 to gradually descend upon the groups of bottles 5. Lowering of the carriers 3 is aided by the overhead declination block assembly 100 in which a series of handle-engaging blocks 102 are mounted upon an endless chain which in turn is in alignment and synchronization with the declination belts. Referring momentarily particularly to FIG. 27, each block 102 has a groove or slot 103 for receiving the handle of a carrier 3. The overhead assembly is disposed with respect to the declination belts 92, 94 and 93, 96 such that as carriers are moved by the belts 92, 94 and 93, 96 the apex of the carrier 3, that is, the top of the handle portion, is engaged by the groove/slot 103 and helps stabilize and reinforce the movement of the downward traveling carriers. The blocks may be spaced for synchronization but a simple means of utilization as illustrated is to have the blocks 102 abut one another so that essentially a continuous grove or slot is formed.

Figure 28:
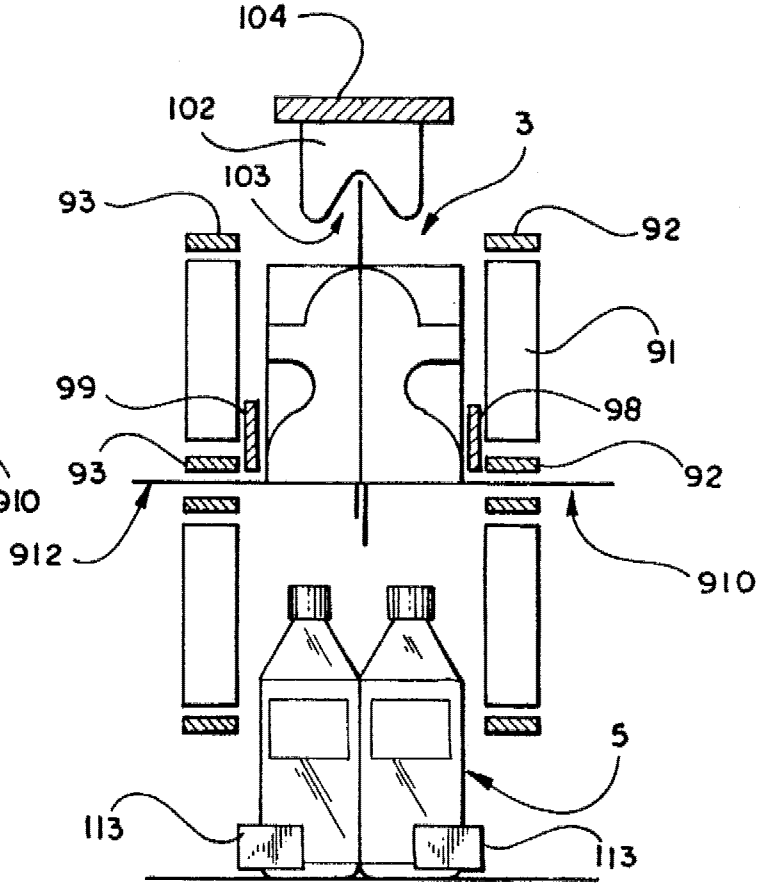
FIGS. 27 and 28 are end elevational views from the declination belt section of the apparatus of FIG. 5.

Referring momentarily to FIG. 28, to further ensure stable movement of carriers 3 an alternate version of the declination belt assembly 90 includes a guide 98, 99 position to engage the fold line created between each bottom panel 910, 912 and an adjacent side wall of the carrier 3. The guide 98, 99 is parallel and coextensive with the length of the belts 92, 94 and 93, 96. The guides 98, 99 thus further aid in lowering the carriers 3 and further stabilization of the carriers 3 as they are lowered.

To obtain optimum performance and reliability from the apparatus 10, rather then being completely lowered over a group of bottles 5, each carrier is only substantially lowered prior to the departure of the carrier panels 910, 912 from the declination belts 92, 94 and 93, 96 and departure of the handle portion from the overhead declination blocks 102.

Figure 30:
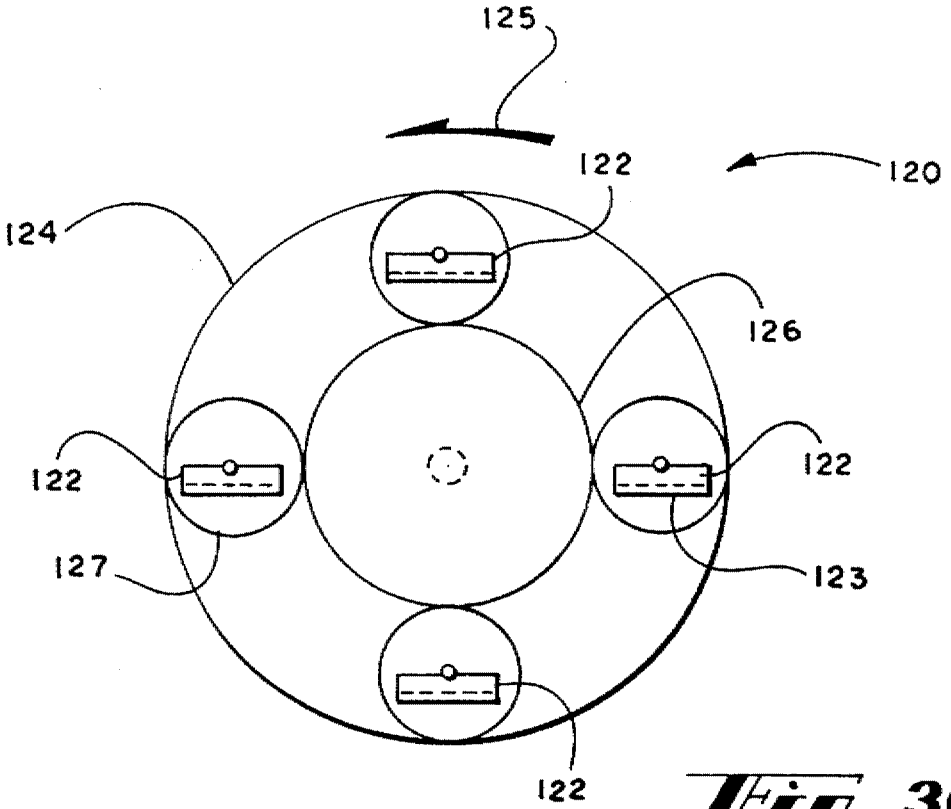
FIG. 30 is an elevational illustration of a planetary gear version of the carrier seating assembly of the apparatus of FIG. 5.

Completed lowering of each carrier 3 over a group of bottles 5 is achieved in the seating wheel assembly 120 which follows the declination belt assembly 90 and overhead declination block 100 assemblies. Carriers 3 and groups of bottles 5 exit the declination belt 90 and overhead declination block 100 assemblies as a unit denoted by the number 6 in FIG. 26. The carrier-bottle unit 6 is a package in which the fully-erected carrier 3 is substantially but not completed lowered over the bottle grouping 5. The carrier 3 is either angularly disposed with respect to the bottle-grouping 5, due to the angular placement of the carrier 3 over the bottles 5, or the carrier 3 may be horizontally disposed as it exits the declination section due to contact of the rearmost end of the carrier handle by the last declination block 102. Referring now also to FIG. 30, the seating wheel assembly 120 is a ferris-wheel-like structure wherein seating blocks 122 are attached to a revolving wheel or drum 124 in a manner which maintains their downwardly-directed (that is, wherein the handle-receiving slot is downwardly directed) orientation. The seating blocks 122 maintain the same orientation as they travel in the circular path of the wheel 124. Suitable means for preservation of the orientation of the seating blocks 122 as the wheel 124 turns is to allow the seating blocks 122 to freely pivot with respect to the wheel. This arrangement is simply illustrated in FIG. 26. A more precise means of maintaining alignment is illustrated in FIG. 30. FIG. 30 illustrates the use of a planetary gear system to maintain the downward orientation of the seating blocks. In FIG. 30, the seating blocks 122 are mounted upon "planet" gears 127 that revolve around a centrally disposed "sun" gear 126 in known mechanical manner.

The seating blocks 122 have a handle-receiving groove or slot 123 like the handle-receiving groove/slot 103 of the overhead declination blocks 102. Since the handle-receiving portion 123 of the seating block 122 is not fully visible in the illustration of FIG. 5 and not visible in FIG. 26, the blocks 102, 122 may be considered identical in this aspect. The rotation of the wheel 124 is synchronized with the movement of the carrier-bottle units 6 so that consecutive seating blocks 122 engage the handles of consecutive carriers of the units 5. The movements of the wheel 124 and carrier-bottle unit conveyor are synchronized such that the handle of a carrier-bottle unit 6 intersects the angular path of the wheel 124 as a the handle-receiving portion 123 of a seating block 122 reaches that same point. Thus, after the seating block 122 engages the handle of a carrier rotation of the wheel moves the block 122 both downward and forward. Placement of the carrier 3 over a group of bottles 5 is thus completed and the carrier is fully "seated" with respect to the group of bottles 5. The unit of a group of bottles 5 and a fully-seated carrier 3 is denoted by the reference numeral 7 in FIG. 26. The unit 7 is now ready for closure.

Figure 27:
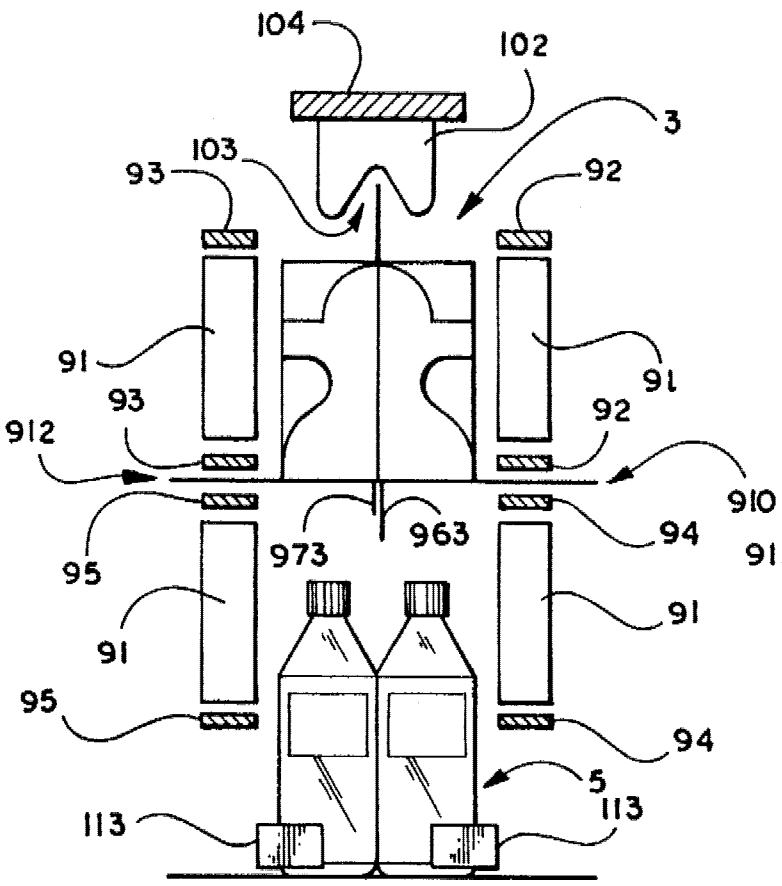
Figure 29:
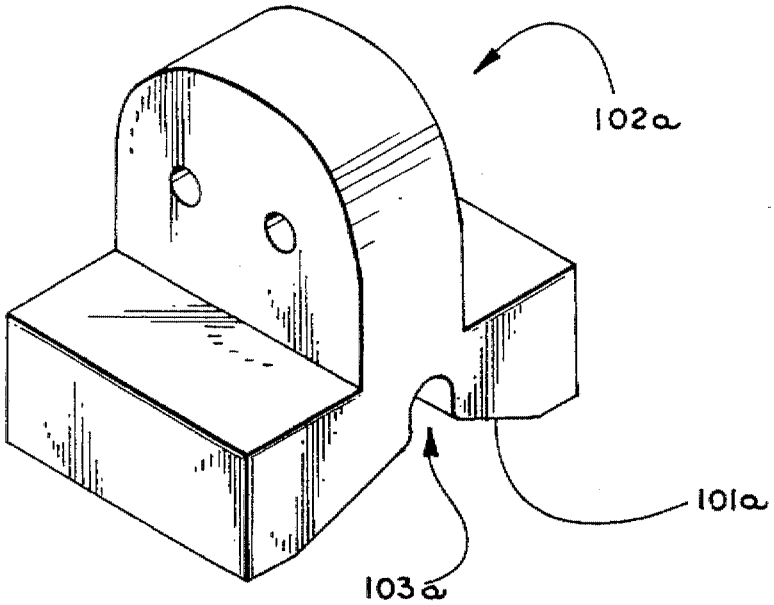
FIG. 29 is an isometric illustration of an alternate version of a declination block of the apparatus of FIG. 5.

In FIGS. 26 and 27 the bottles 1 are shown in groupings 5 of two by three arrays, a total of six bottles per group. However, as previously mentioned, it is noted that the system of the invention works well with various multiples of bottles to be packaged. To reinforce this point, the description and illustrations of the preferred embodiment utilize both six-and eight-bottle configurations. For example, the bottle grippers 114 illustrated in the isometric schematic of FIG. 5 is configured for an eight-bottle group while the carriers 3 and bottle groupings in other illustrations depict a six-bottle configuration. The principles of the invention are equally applicable to both six- and eight-bottle configurations as well as other arrayed configurations. Referring now briefly to FIG. 29, in an alternate version of the overhead declination block 102*a* bevelled bottom walls 101*a* lead to the groove, or slot, (103*a*) for receiving the carrier handle.

Folder and Gluer

Referring now again particularly to FIG. 5, upon leaving the seating portion 120 of the apparatus 10 each package 7 is engaged and transported by a package lug assembly 130. The package lug assembly 130 primarily consist of a pair of opposing endless chains 132 upon which are mounted lugs 134 that engage each package 7. Closure of the carton 3 of each package 7 is accomplished in the folding and gluing area 140 of the apparatus 10 as the packages are moved along by the package lugs 134.

Figure 31:
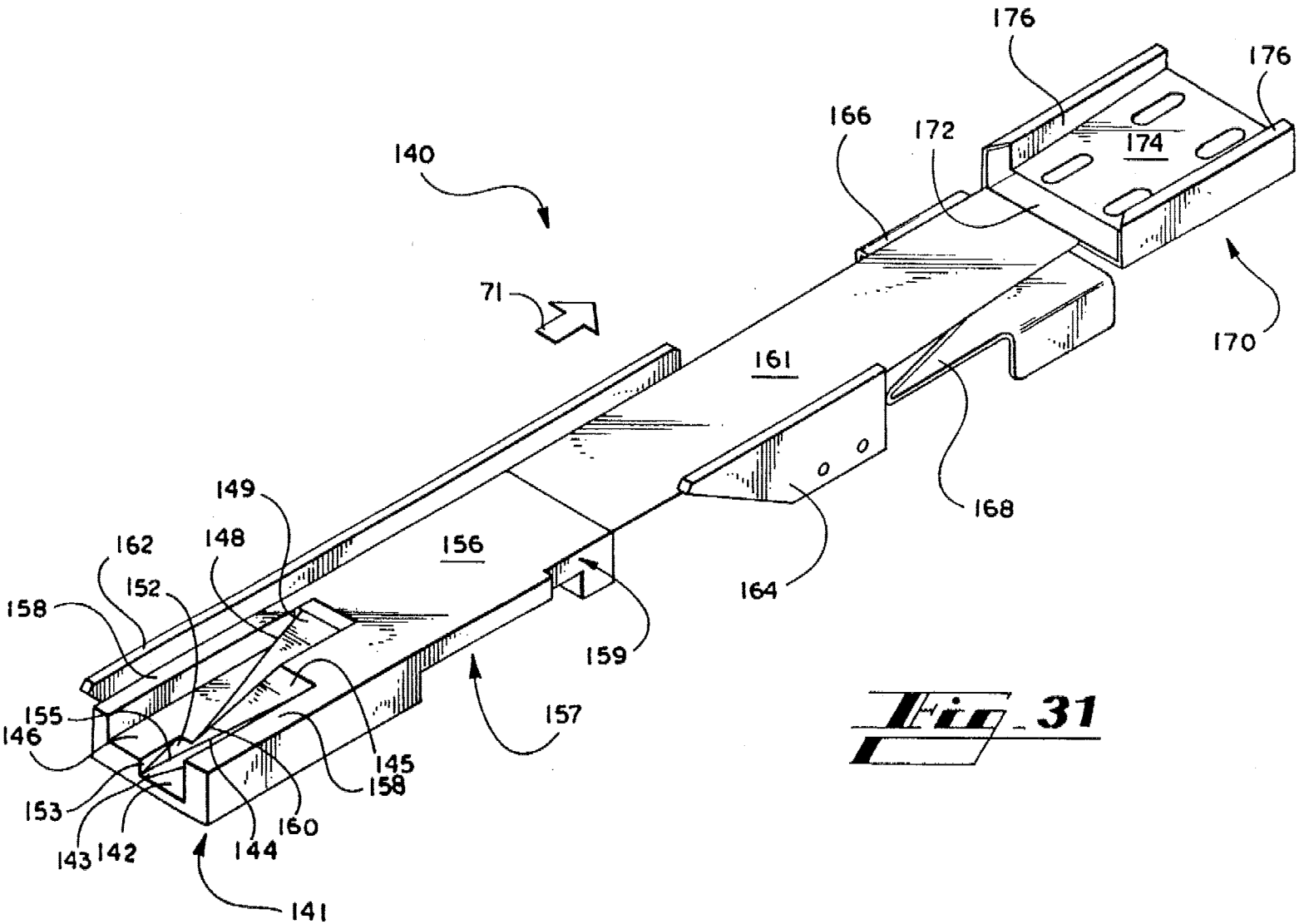
FIG. 31 is an isometric illustration of a folder-gluer assembly of the apparatus of FIG. 5.
Figure 32:
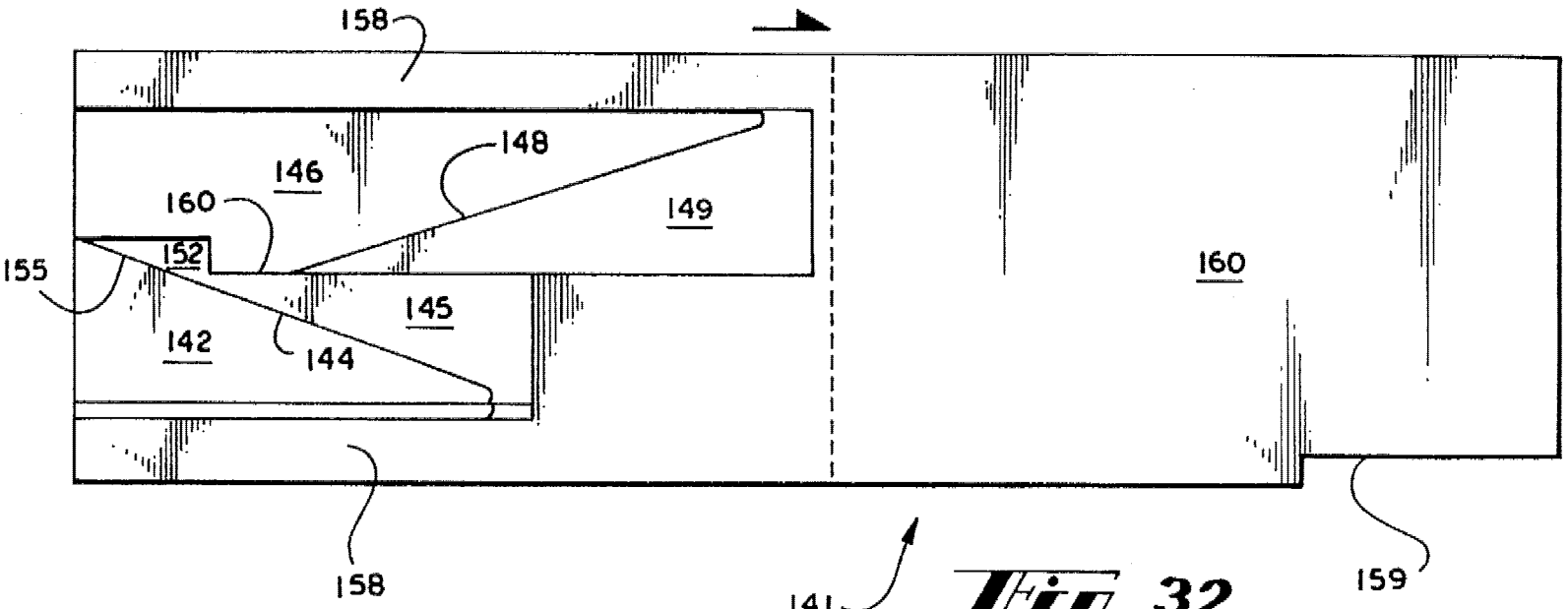
FIG. 32 is a top plan view of the folding block of the folder-gluer assembly of FIG. 31.
Figure 33:
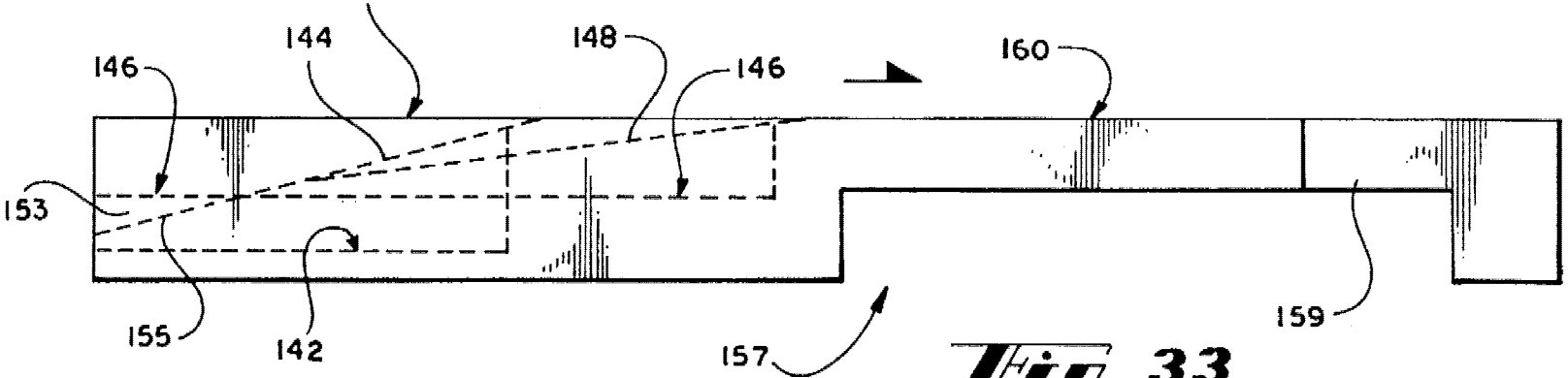
FIG. 33 is a side elevational view of the folding block of the folder-gluer assembly of FIG. 31.
Figure 34:
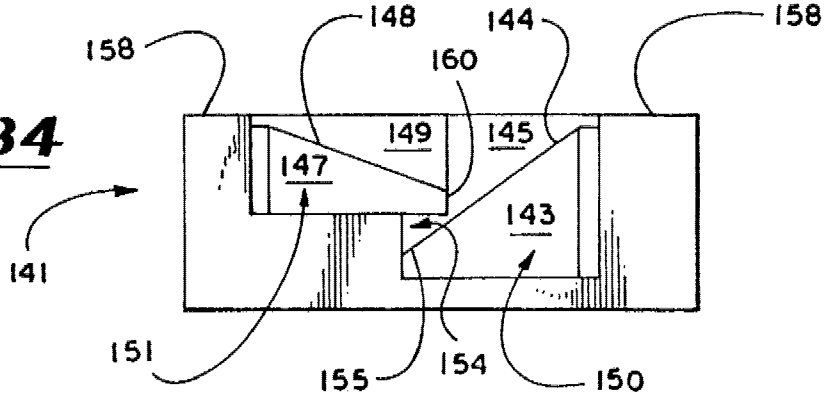
FIG. 34 is a side elevational view of the folding block of the folder-gluer assembly of FIG. 31.

Referring now particularly to FIG. 31, therein is illustrated a folder-gluer assembly 140 of the apparatus for loading bottom-loading basket-style carriers 10 according to a preferred embodiment of the invention. The gluing operation will be discussed later, however, for clarity of understanding it is now noted that glue is applied to the interior side (that is, the side which faces the inside of the erected carrier 3) of the so-called greater bottom wall panel 912 of the carrier 3. Glue is applied to adhere the riser panel support tabs 961, 963, 971, 973 to the interior side of the greater bottom wall panel 912. In a version of the carrier without support tabs 961, 963, 971, 973 folding and adherence of the support tabs would obviously not be necessary for such a carrier. The elements of the folder-gluer assembly 140 are positioned to fold the elements of the carrier 3 in sequence. In addition to the illustration of FIG. 31, reference may now also simultaneously be made to FIGS. 32, 33, 34 and 35 which contain additional views of the folder-gluer feature and any of the previously described figures which illustrate the panels 910, 912 and support tabs 961, 963, 971, 973. The folding features of the folder 140 are static elements that engage applicable panels and flaps of carriers 3 as the packages 7 are moved by the package lugs 134 in the direction indicated by the direction arrow 71. As the packages approach the folding section the bottom panels flaps 910, 912 are generally more horizontally inclined rather than downwardly vertically oriented. In the folding section, the bottom panels 910, 912 are first folded vertically downward, then under the carrier 3 into face-to-face relationship for later locking. The support tabs 961, 963, 971, 973 are folded into a horizontal position. The support tab folding elements are contained in what is conveniently referred to as a tab folding block 141. Consistent with the carrier orientation discussed above, the greater bottom panel flap 912 is the first of the two bottom panel flaps 190, 912 engaged. The greater panel flap 912 is engaged and caused to be folded vertically downward by the inclined edge of the first vertical panel-folding wedge 162. The first vertical panel-folding wedge 162 folds the greater panel 912 to a vertically downward position wherein it is sandwiched between the wedge 162 and the folding block 141. The folding block 141 provides edges and surfaces which separate and fold the support tabs into place and spaces which accommodate the tabs as they are being manipulated. Each pair of a long and short support tab 961 & 971, 963 & 973, at opposing ends of the carrier is engaged simultaneously by the block 141 (note FIG. 3, the end of the carrier with support tabs 961, the longer tab, and 971, the shorter tab, is the leading end). From a point of view facing the front portion of the support block 141, as in FIG. 34 in particular, the right side of the block 141 is configured to engage and accommodate the longer tabs 961, 971 while the left side is configured to engage and accommodate the longer tabs 963, 973. The block 141 first separates each long tab 961, 963 from its accompanying short tab 971, 973. A horizontal facet 142 and a vertical facet 143 form a wedge-like cove 159 for the longer, or major, tab 961, 963. A recess 154 for the minor tab is formed by an inclined facet 152 and a vertical facet 153. A short upwardly-inclined edge 155 at the intersection of facet 143 and 152 engages the major support tab 961, 963. As the carrier advances, the major support tab 961, 963 moves divergingly away from the minor support tab 971, 973 along the edge 155. The leading major tab folding edge 155 intersects and is continued by a trailing major tab folding edge 144. The trailing major tab folding edge 144 is formed at the intersection of the major tab vertical facet 143 and the upwardly-inclined major tab ramp 145. As the carrier 3 continues its travel the major support tab 961, 971 continues its diverging ascent along trailing major tab folding edge 144. Because the major tab ramp 145 and the trailing major tab folding edge 144 also diverge outwardly as well as upwardly, the major support tab 961, 971 ultimately is placed in and travels in face contacting relationship with the major tab ramp 145. As the carrier continues to travel, the major support tab 961, 971 subsequently comes into face contacting relationship with the horizontal surface 156 of the folding block. As the major support tab 961, 963 is folded to the right side of the folding block 141 as described, the minor support tab 971, 973 is folded to the left. The minor tab recess 154 of the block 141 provides space for the minor tab 971, 973 of the carrier 3 to be initially separated from the major tab 961, 963. The minor tab 971, 973 is initially engaged by the leading minor tab folding edge 160. The leading minor tab folding edge 160 is formed at the intersection of the planes of the minor tab vertical facet 147 and the major tab ramp 145, and intersects the trailing minor tab folding edge 148. The trailing minor tab folding edge 148 is formed at the intersection of the minor tab vertical facet 147 and the minor tab ramp 149. The minor tab 971, 973 is moved outwardly and upwardly with respect to the carrier 3 by the outwardly and upwardly diverging edge 148. Further downstream movement of the carrier 3 causes the minor tab 971, 973 to come into face-contacting relation with the minor tab ramp. As the carrier 3 begins its travel upon the folding block 141 the bottles 3 in the carrier are supported on their undersides by the support ledges 158. When the carrier package 7 reaches the horizontal surface 156 of the folding block the major 961, 963 and minor 971, 973 tabs have been folded outwardly and into flat face relationship with the underside of bottles 3 of each package 7. As the conveyor continues to transport a package 7 downstream, glue is applied by convention means such as a glue gun to the downwardly-extending greater bottom wall panel 912 as mentioned above. Glue is applied to the central portion of the panel 912 in a position suitable for the support tabs 961, 963, 971, 973 to be adhered thereto when the greater panel is folded up into flat face relation with the bottom of the package 7. Glue is applied at a convenient location such as the gluer recess 157 provided.

Figure 35:
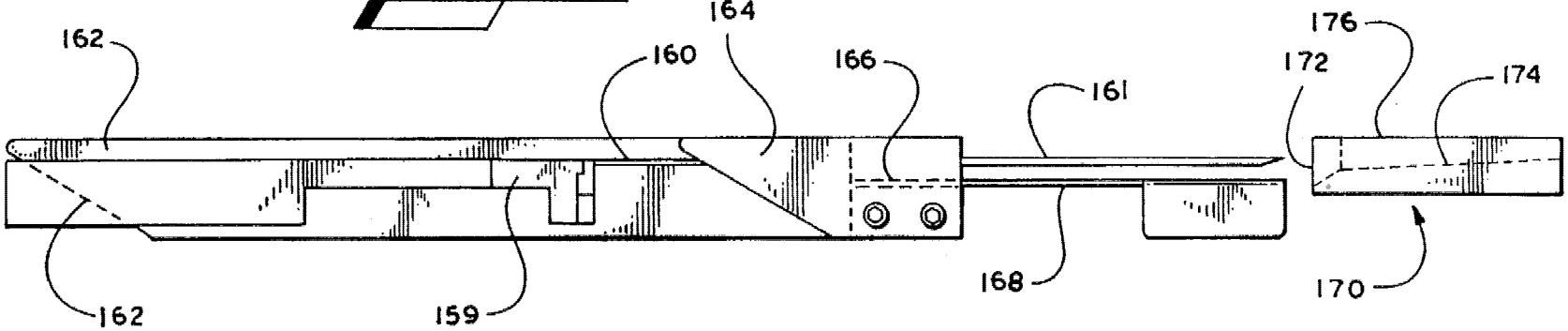
FIG. 35 is a side elevational view of the folding block and sealing block of the folder-gluer assembly of FIG. 31.

Referring particularly now to FIGS. 31 and 35, after glue has been applied to the bottom panel 912 the bottom of the carrier 3 is closed and locked in successive stages. The dead plate 161 following the folding block 141 provides a suitable static surface upon which the package 7, and bottles 3 in the package in particular, may glide during further transport. The second vertical panel folding wedge 164 engages and folds the lesser bottom wall panel 910 downward in the same manner as the first vertical panel-folding wedge 162 folds the greater panel 912 as described above. The greater 912 and lesser 910 bottom panels are sandwiched between respective first 162 and second 164 panel-folding wedges and the dead plate 161. The first horizontal panel-folding wedge 166 and second horizontal panel-folding wedge 168 fold the respective bottom panels 912, 910 into their closing position of flat face relationship with one another. As can be more clearly seen in FIG. 35, the first horizontal panel-folding wedge 166 is longer and engages and folds the glue-containing greater panel 912 under before the lesser bottom panel is manipulated. The lesser bottom panel 910 thus becomes the outer-most of the two bottom panels.

The bottom wall sealing plate 170 follows the dead plate 161 and provides a surface 174 upon which the support tabs 961, 963, 971, 973 and glue-containing greater bottom panel 912 are caused to be pressed together thereby adhering the support tabs 961, 963, 971, 973 to the greater bottom panel 912. The bevelled lip 172 at the front of the sealing plate 170 helps the package 7 enter the sealing plate 170 without becoming easily snagged. To ensure a smooth transition from the deadplate 161 to the sealing plate 170, the bevelled lip 172 of the sealing plate 170 is positioned lower than the deadplate 161 and horizontal folding wedges 166, 168 and the plate 170 itself is positioned sufficiently close to the deadplate 161 to permit the bottom the bottom panels 910, 912 to engage the bevelled lip 172 without snagging. The side walls 176 of the sealing plate 170 urge the side walls of the carrier 3 inwardly to a desired position and help keep the transported packages 7 properly aligned during transport. The front portion of each sidewall 176 is inwardly bevelled to also help guide the package onto the sealing plate 170 between the walls 176.

Closure of the Carrier

Figure 36:
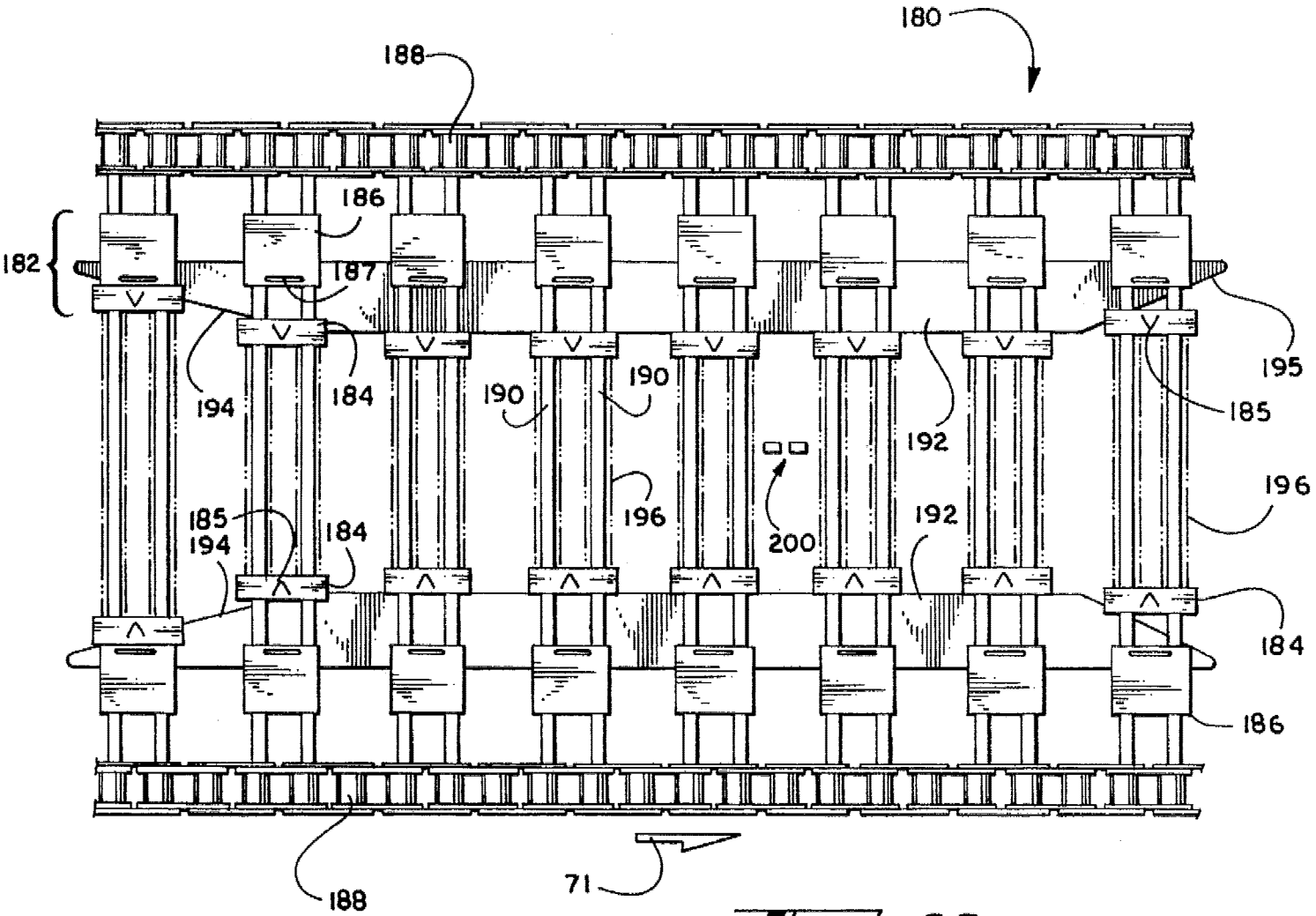
FIG. 36 is a top plan view of the bottom-panel alignment assembly.

Closure of the bottom of the carrier 3 may be achieved by several means. For example, adherence of the bottom panels 910, 912 to one another by an adhesive. Another effective means for closure is the use of a locking mechanism known as a "punch lock" in the packaging field wherein the outermost of the two bottom panels has male locking members that are superimposed over female corresponding female apertures and members formed in the inside bottom panel. To help effectively close the bottom of the carrier 3, particularly if the carrier will be closed utilizing a punch lock, the two bottom panels 910, 912 can be drawn inwardly to help align the two bottom panels 910, 912. This is particularly useful, and necessary, to engage male and female lock features and is also useful to generally ensure that the carrier 3 is in its optimum squared-up condition with the bottom panels 910, 910 overlapping by a predetermined amount. Referring now to FIG. 36, the bottom panels 910, 912 are urged into predetermined face-to-face alignment with one another by means of conveyor-mounted lug sets 182 in the bottom-panel alignment assembly. The lug sets 182 engage pull holes (also known as alignment apertures or tightening apertures) 914 (which can be seen in FIG. 3 and 3) in the bottom panels 910, 912 of the carriers 3. Each lug set 182 has an outwardly-biased moveable lug member 184 and a stationary lug member 186. Outward biasing may be accomplished by the spring 196 shown or other suitable biasing mechanism. A pair of opposing lug sets 182 is mounted upon a pair of support rods 190. The pairs of lug sets 182 are mounted upon conveyors such as endless chains 188. The moveable lug member 184 of each set is spring-biased outwardly and is moved inwardly along the support rods 190 through moving contact with the cam rail 192. The moveable lug members 184 of the lug sets 182 are in a retracted position prior to translating inwardly upon the ramp 194. The tightening apertures 914 of the carriers 3 are initially engaged by the lug sets 182 when the moveable lug members 184 are retracted (that is, prior to riding up the ramp 194). Each moveable lug member 184 has a angular-shaped protruding portion 185 that is configured to correspond to and be closely received by the apex of the triangular-shaped tightening apertures 914. Each stationary lug member 186 has a lip-like linear protruding portion 187 that is configured to correspond to and be closely received by the base of the triangular-shaped tightening apertures 914. As previously discussed, the bottom panels 910, 912 of carriers 3 are in face-to-face partially overlapping relationship when the packages 7 leave the folding and gluing area 140 of the apparatus 10. As the moveable lug members 184 travel the leading ramp 194 they pull the bottom panels 910, 912 inwardly to a predetermined position. The stationary lug members 186 help prevent the bottom panels 910, 912 from being drawn too far inwardly. The leading ramp 194 may be stepped in known manner to provide two tiers of ramps for the moveable lugs 184 so that leading and trailing moveable lug members may move inwardly essentially simultaneously to prevent a "scissoring" effect when the bottom panels 910, 912 are drawn together. In this arrangement cam followers of the leading moveable lug members engage only the upper-tiered ramp. The upper-tiered ramp is more steeply inclined than the lowered-tiered ramp. The less steep lowered-tiered ramp is contacted only by the cam followers of the trailing moveable lug members. Because of the difference in pitches of the two ramps the leading lug members are delayed in their inward movement until the trailing lug members are also moving inwardly. After the bottom panels 910, 912 have been tightened a predetermined amount and held in place by the lug sets, 182 punch lock features may be engaged by means of conventional rotating fingers 200 which synchronously protrude upwardly through the alignment assembly 180. The moveable lug members 184 are allowed to retract to their outwardmost position by a ramp 195 at the trailing (or exit) end of the cam rail 192.

The fully-closed packages 7 may then exit the apparatus by conventional means.

Figure 37:
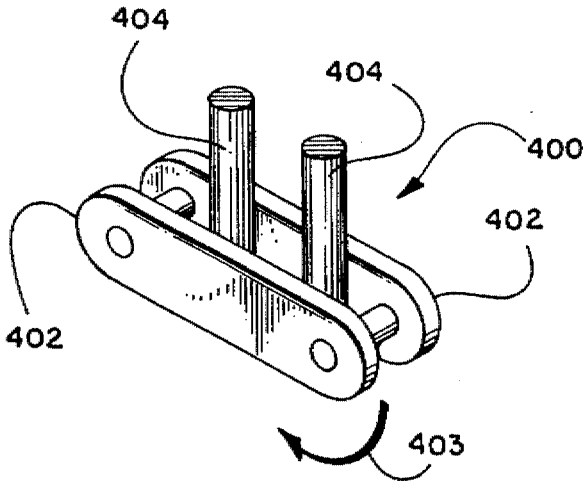
FIG. 37 is an isometric illustration of a bottle stabilizer assembly for the apparatus of FIG. 5.
Figure 38:
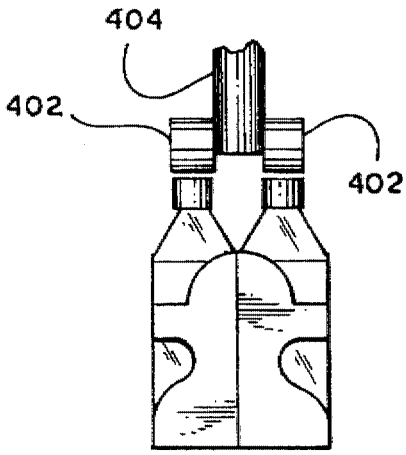
FIG. 38 is an end view of the bottle stabilizer assembly of FIG. 37 in engagement with a carrier package.

Referring now to FIGS. 37 and 38, as the bottom panels 910, 912 of the carrier 3 are drawn together the tops of bottles are engaged by belts 402 of a bottle stabilizer assembly 400. The belts 402 rotate in the same direction as the direction of carrier travel and at the same speed. The bottle stabilizer 400 prevents bottles from rising upwardly out of the carrier as the bottom panels 910, 912 are drawn together as described above.

Other modifications may be made in the foregoing without departing from the scope and spirit of the claimed invention.

What is claimed is:

1. An apparatus for loading containers into open-bottomed carriers, the carriers having a pair of opposing bottom panels adjoining side walls thereof, the apparatus comprising:

a container feeder assembly having conveyor mechanism for translating at least one column of a series of groupings of predetermined numbers of containers along a first level;

a carrier feeder for retrieving the carriers from a carrier infeed supplier;

a carrier timer-transport assembly disposed in operative communication with said carrier feeder for receiving the carriers from said carrier feeder and initiating transport of the carriers in synchronous parallel motion with said at least one column of a series of groupings of predetermined numbers of containers at a second level above said first level such that the carriers are aligned over respective ones of said groupings of predetermined numbers of containers;

a gripper assembly for grasping and pulling the bottom panels of the carriers outwardly with respect to a centerline thereof such that the bottom panels are substantially transversely disposed with respect to side walls of the carriers and the sidewalls of the carrier are disposed in erected condition distal the centerline of the carrier as the carriers are translated;

a declination belt assembly having a pair of continuous downwardly-declining pathways each defined by at least one downwardly-declining elongated endless belt having a face adapted for receiving in direct face contacting relationship therewith transversely extended bottom panels of the carriers and transporting the carriers in synchronous downwardly-declining linear motion over respective ones of said groupings of predetermined numbers of containers; and a bottom panel closure mechanism for securing the bottom panels of each carrier together.

2. The apparatus of claim 1, further comprising a seating assembly having a plurality of seating members for engaging tops of handles of the carriers, said seating members in rotatable cooperative disposition with respect to the carriers which have been placed over said groupings of containers such that as said seating members rotate bottommost ones thereof engage the respective tops of the handles of the carriers.

3. The apparatus of claim 1, said at least one column of a series of groupings of containers comprising at least two columns.

4. The apparatus of claim 1, wherein said at least one downwardly-declining elongated endless belt comprises a downwardly-declining pair of opposing elongated endless belt pairs in face-to-face relationship.

5. A method for loading containers into bottom-loading carriers, the carriers having a pair of opposing bottom panels adjoining side walls thereof, the method comprising:

translating the containers along a first level in at least one column of a series of groupings of predetermined numbers of the containers;

retrieving the carriers from an infeed supply of the carriers and transporting the carriers in synchronous parallel motion with said at least one column of a series of groupings of predetermined numbers of containers at a second level above said first level such that the carriers are aligned over respective ones of said groupings of predetermined numbers of containers;

as the carriers are translated, grasping and pulling the bottom panels of the carriers outwardly with respect to a longitudinal centerline thereof such that the bottom panels are substantially transversely disposed with respect to side walls of the carriers and such that the sidewalls of the carrier are disposed in erected condition distal the centerline of the carrier;

engaging and translating the bottom panels of the carriers along a continuous longitudinal portion thereof and thereby transporting the carriers in synchronous downwardly-declining linear motion over respective said groupings of predetermined numbers of containers; and securing the bottom panels of each carrier together to form a closure therewith.

6. The method of claim 5, where the step of translating the containers along a first level in at least one column comprises translating the containers along a first level in at least two columns of a series of groupings of predetermined numbers of the containers.

7. An apparatus for loading containers into open-bottomed carriers having transversely extendable panels extending from side walls, the apparatus comprising:

a pair of continuous downwardly-declining pathways each defined by at least One downwardly-declining elongated endless belt having a face adapted for receiving in direct face contacting relationship therewith transversely extended panels of the carriers and transporting the carriers in synchronous downwardly-declining linear motion over linearly translating groupings of predetermined numbers of containers.

8. The apparatus of claim 7, wherein said at least one downwardly-declining elongated endless belt comprises a downwardly-declining pair of opposing elongated endless belt pairs in face-to-face relationship.

9. A method for loading containers into open-bottomed carriers having transversely extendable panels extending from side walls thereof, the method comprising:

grasping and translating transversely extended panels of the carriers along a continuous longitudinal portion thereof by at least one belt face and thereby transporting the carriers in synchronous downwardly-declining linear motion over linearly translating groupings of predetermined numbers of containers.

* * * * *